US008943783B2

(12) United States Patent
Ouellet et al.

(10) Patent No.: US 8,943,783 B2
(45) Date of Patent: Feb. 3, 2015

(54) SYSTEM AND METHOD FOR HANDLING WICKET BAGS

(75) Inventors: Jean-Claude Ouellet, St-Jean-Port-Joli (CA); Sylvain Bilodeau, Québec (CA); Olivier Marcotte, Québec (CA); Denis Lépine, Québec (CA); Nicolas Deschênes, Québec (CA); Denis Hotte, L'Ancienne-Lorette (CA); Bertrand Maheux, Québec (CA)

(73) Assignee: Centre de Recherche Industrielle du Quebec, Quebec (CA)

( * ) Notice: Subject to any disclaimer, the term of this patent is extended or adjusted under 35 U.S.C. 154(b) by 218 days.

(21) Appl. No.: 13/611,883

(22) Filed: Sep. 12, 2012

(65) Prior Publication Data

US 2013/0192720 A1 Aug. 1, 2013

(30) Foreign Application Priority Data

Jan. 26, 2012 (CA) ..... 2765667

(51) Int. Cl.
*B65B 51/08* (2006.01)

(52) U.S. Cl.
USPC ..... 53/469; 53/468; 53/471; 53/139.1; 53/138.7; 53/272; 53/282; 53/284.7

(58) Field of Classification Search
USPC ..... 53/469, 467, 468, 471, 139.1, 138.7, 53/138.8, 268, 272, 281, 282, 284.7
See application file for complete search history.

(56) References Cited

U.S. PATENT DOCUMENTS

| | | | | | |
|---|---|---|---|---|---|
| 3,971,191 | A | | 7/1976 | Hoyland | |
| 4,124,966 | A | | 11/1978 | Wilson | |
| 4,457,124 | A | | 7/1984 | Hartmann | |
| 4,510,733 | A | | 4/1985 | Hansen | |
| 4,696,146 | A | | 9/1987 | Esch | |
| 4,726,170 | A | | 2/1988 | Sawa | |
| 4,914,895 | A | | 4/1990 | Kuckhermann | |
| 5,001,889 | A | | 3/1991 | Mueller | |
| 5,442,898 | A | * | 8/1995 | Gabree et al. | 53/459 |
| 5,495,707 | A | * | 3/1996 | Lauzon | 53/572 |
| 5,673,541 | A | * | 10/1997 | Arzuman et al. | 53/459 |
| 5,722,217 | A | * | 3/1998 | Cloud | 53/455 |
| 5,771,665 | A | * | 6/1998 | Nelson et al. | 53/459 |
| 5,802,817 | A | * | 9/1998 | Hood | 53/459 |

(Continued)

FOREIGN PATENT DOCUMENTS

| | | | |
|---|---|---|---|
| CA | 1092566 | A1 | 12/1980 |
| CA | 1256077 | A1 | 6/1989 |

(Continued)

*Primary Examiner* — Christopher Harmon
(74) *Attorney, Agent, or Firm* — Jean-Claude Boudreau

(57) ABSTRACT

A system and method for handling wicket bags involve a wicket bag holder for transporting wicket bags to a working position along a transport path, the bag holder including one or more holding devices each being operable between an open position allowing receipt of an upper tab of the wicket bag and a closed position whereby the bag is held suspended within a working zone. Also involved are one or more main gripping devices each being operable between an open position allowing receipt of a suspended wicket bag and a closed position whereby the bag is gripped to form a bag neck portion. The system and method may be used for bag filling applications.

55 Claims, 42 Drawing Sheets

(56) References Cited

U.S. PATENT DOCUMENTS

| | | | | |
|---|---|---|---|---|
| 6,094,891 | A * | 8/2000 | Savigny et al. | 53/459 |
| 6,112,504 | A | 9/2000 | McGregor | |
| 6,550,226 | B1 | 4/2003 | Gates | |
| 6,662,532 | B1 * | 12/2003 | Droog et al. | 53/459 |
| 6,789,963 | B2 | 9/2004 | Brahier | |
| 7,003,931 | B2 * | 2/2006 | Gates et al. | 53/459 |
| 7,024,840 | B2 * | 4/2006 | Wilson, Jr. et al. | 53/572 |
| 7,322,163 | B2 | 1/2008 | Griggs | |
| 7,617,655 | B2 | 11/2009 | Gill | |
| 2004/0025959 | A1 | 2/2004 | Schlosser | |
| 2004/0182469 | A1 | 9/2004 | Concetti | |

FOREIGN PATENT DOCUMENTS

| | | | |
|---|---|---|---|
| CA | 2014131 | A1 | 10/1991 |
| CA | 2009640 | C | 3/1994 |
| CA | 2249849 | A1 | 4/1999 |

* cited by examiner

SYSTEM AND METHOD FOR HANDLING WICKET BAGS

FIELD OF THE INVENTION

The present invention relates to the field of product packaging, and more particularly to systems and methods for handling wicket bags.

BACKGROUND OF THE INVENTION

Wicket bags are widely used by high-speed automatic equipment designed for packaging applications in many industrial fields such as agricultural, food such as cheese and bakery, hardware items and retail products industries. Typically, a wicket bag is a bag made of soft plastic material such as polyethylene, and provided with an upper tab adjacent the mouth of the bag, which tab is provided with a plurality of holes adapted to be received in corresponding wicket or pins provided on a holder capable of supporting stack of such wicket bags. The bag tab is adapted to be separated from the useful part of the bag, though a partially cut junction, generally after the bag filling operation, and before the bag closing operation usually performed using twist tie, clip, tape closure or heat-sealing. To provide high-speed operation, known automatic packaging equipment using wicket bags generally make use of complex systems for handling the wicket bags being transported to the desired working position. Such known automatic wicket bag handling systems are disclosed in many patent prior patent documents: U.S. Pat. Nos. 6,662,532 B1; 6,550,226 B1; ,696,146; 4,124,966 and CA 2,249,849 A1. Amongst the handling operations generally involved, an important one consists of reliably forming at high speed a neck portion at a precise location on the bag with high repeatability.

SUMMARY OF THE INVENTION

It is a main object of the present invention to provide a system and a method for handling wicket bags which is capable of forming a neck portion at a precise location on the bag.

According to the above-mentioned main object, from a broad aspect of the present invention, there is provided a system for handling wicket bags, comprising a conveyer provided with at least one wicket bag holder each capable of transporting at least one wicket bag to at least one working position along the transport path of the conveyer. The wicket bag holder includes at least one holding device operable between an open position allowing receipt of an upper tab provided on the wicket bag and a closed position whereby the bag is held suspended within a working zone at the working position, and at least one main gripping device coupled to a mechanical arrangement for bringing thereof toward the working zone and operable between an open position allowing receipt of the suspended wicket bag at a main gripping level below the bag upper tab and above a fillable portion of the wicket bag, and a closed position whereby the bag is gripped at said level to form a bag neck portion. The system further comprises a controller operatively connected to the conveyer. In an embodiment, a bag guiding device is disposed in substantially horizontal alignment with the bag working zone when the wicket bag has been transported to the working position, the guiding device being operable between a bag engaging position to direct the suspended wicket bag toward the main gripping device and to cooperate therewith to form the bag neck portion, and a bag releasing position during transport of the wicket bag.

According to the same main object, from another broad aspect, there is provided a method a method for handling wicket bags comprising the steps of:

i) providing a wicket bag holder capable of transporting at least one wicket bag to at least one working position and provided with at least one holding device;
ii) operating the holding device to an open position allowing receipt of an upper tab provided on the wicket bag;
iii) operating the holding device to a closed position whereby the bag is held suspended within a working zone at the working position;
iv) providing and bringing a main gripping device to the working zone;
v) operating the gripping device to an open position allowing receipt of the suspended wicket bag at a main gripping level below the bag upper tab and above a fillable portion of the wicket bag; and
vi) operating the gripping device to a closed position whereby the bag is gripped at said level to form a bag neck portion.

BRIEF DESCRIPTION OF THE DRAWINGS

Preferred embodiments of the present invention will now be described in detail with reference to the accompanying drawings in which:

FIGS. 28 to 32 are an elevation view of the bag shaping station of FIG. 27, shown in various operation positions;

DETAILED DESCRIPTION OF THE PREFERRED EMBODIMENTS

While the systems, devices and methods as described below are well adapted for handling wicket bags for the purpose of bagging food such as cheese curds, their design can be readily adapted for other packaging applications involving various types of food products such fruits and vegetables, sweetmeat and pastry, or other products such as hardware items and other similar articles of manufacture.

Figure 1:
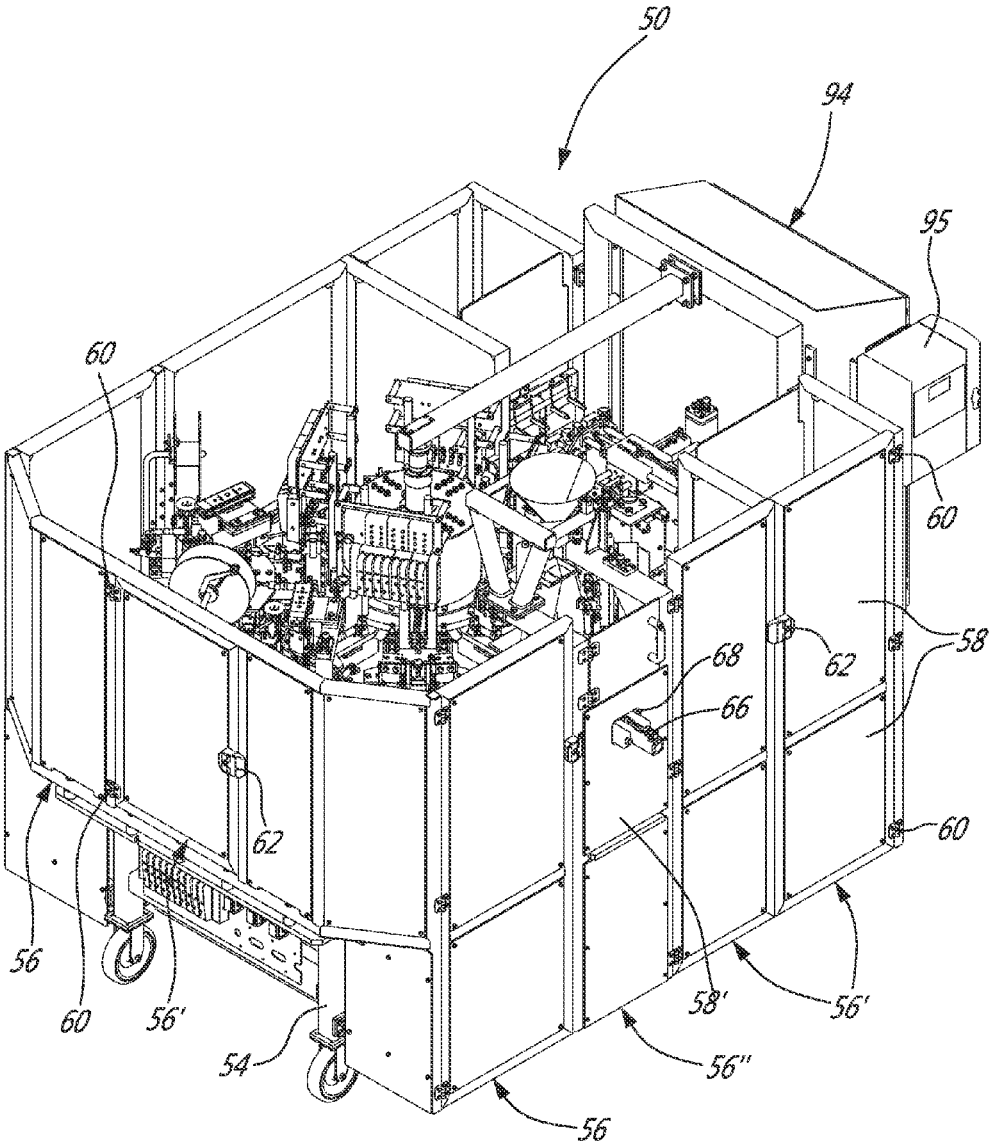
FIG. 1 is a perspective view of a wicket bag handling system shown from rear and left sides thereof, and provided with a shielding fence.
Figure 2:
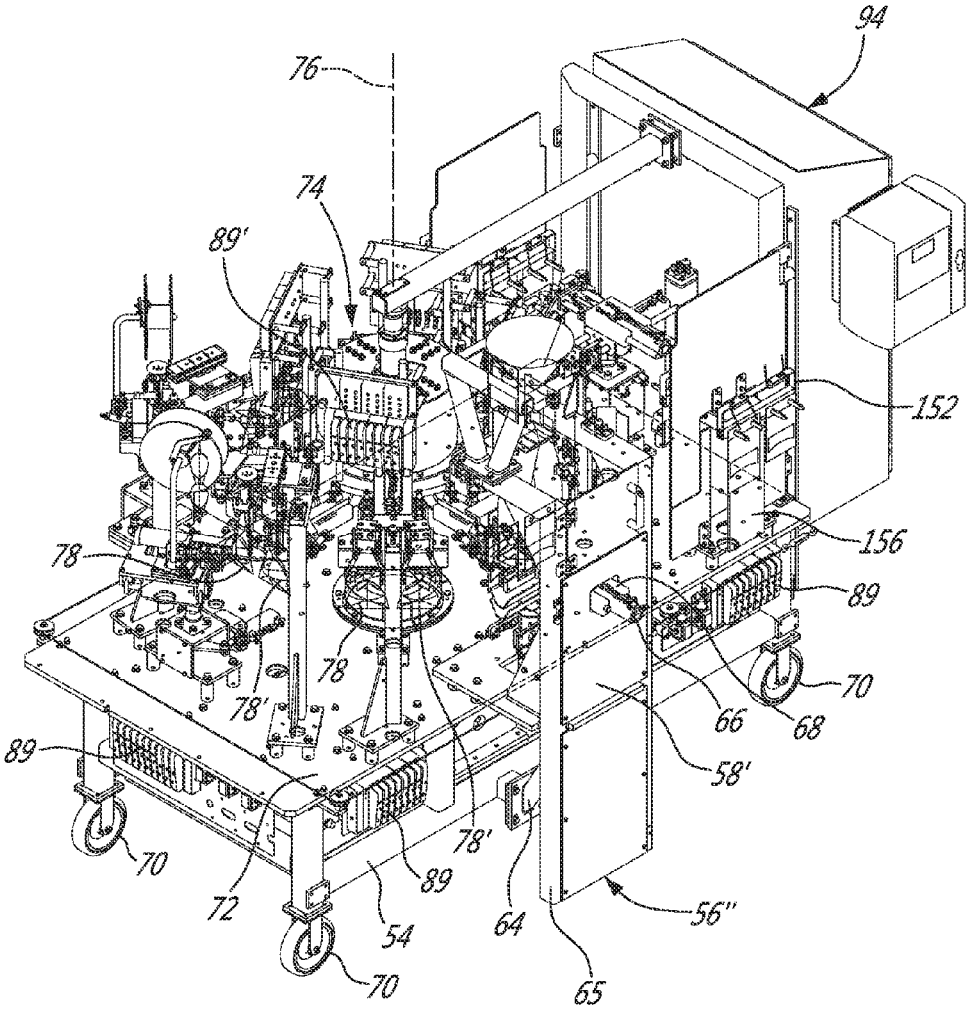
FIG. 2 is is a perspective view of the wicket bag handling system of FIG. 1, wherein most of the shielding fence has been removed, showing generally the operating mechanical components.
Figure 3:
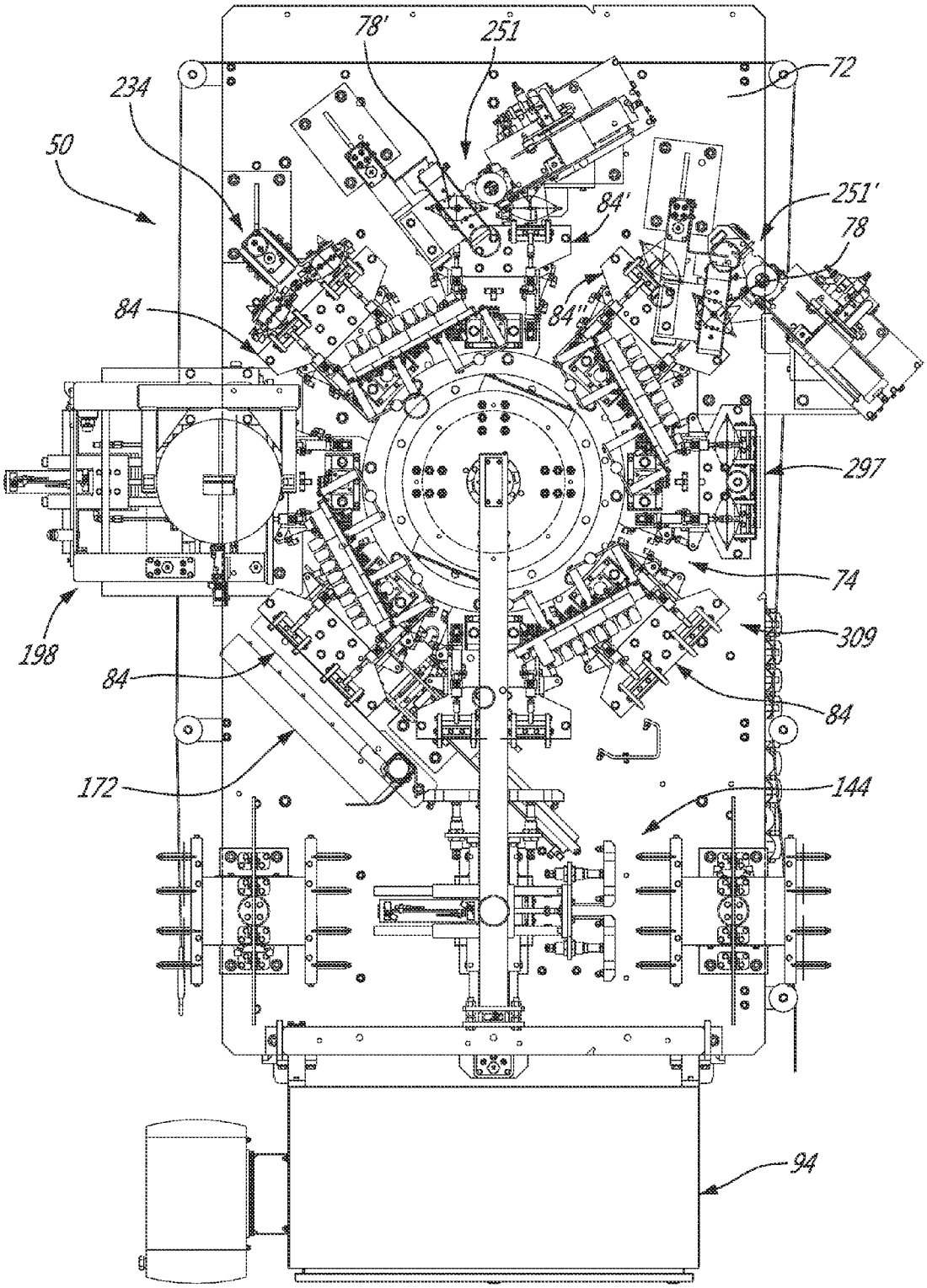
FIG. 3 is a plan view of the wicket bag handling system of FIG. 2.
Figure 8:
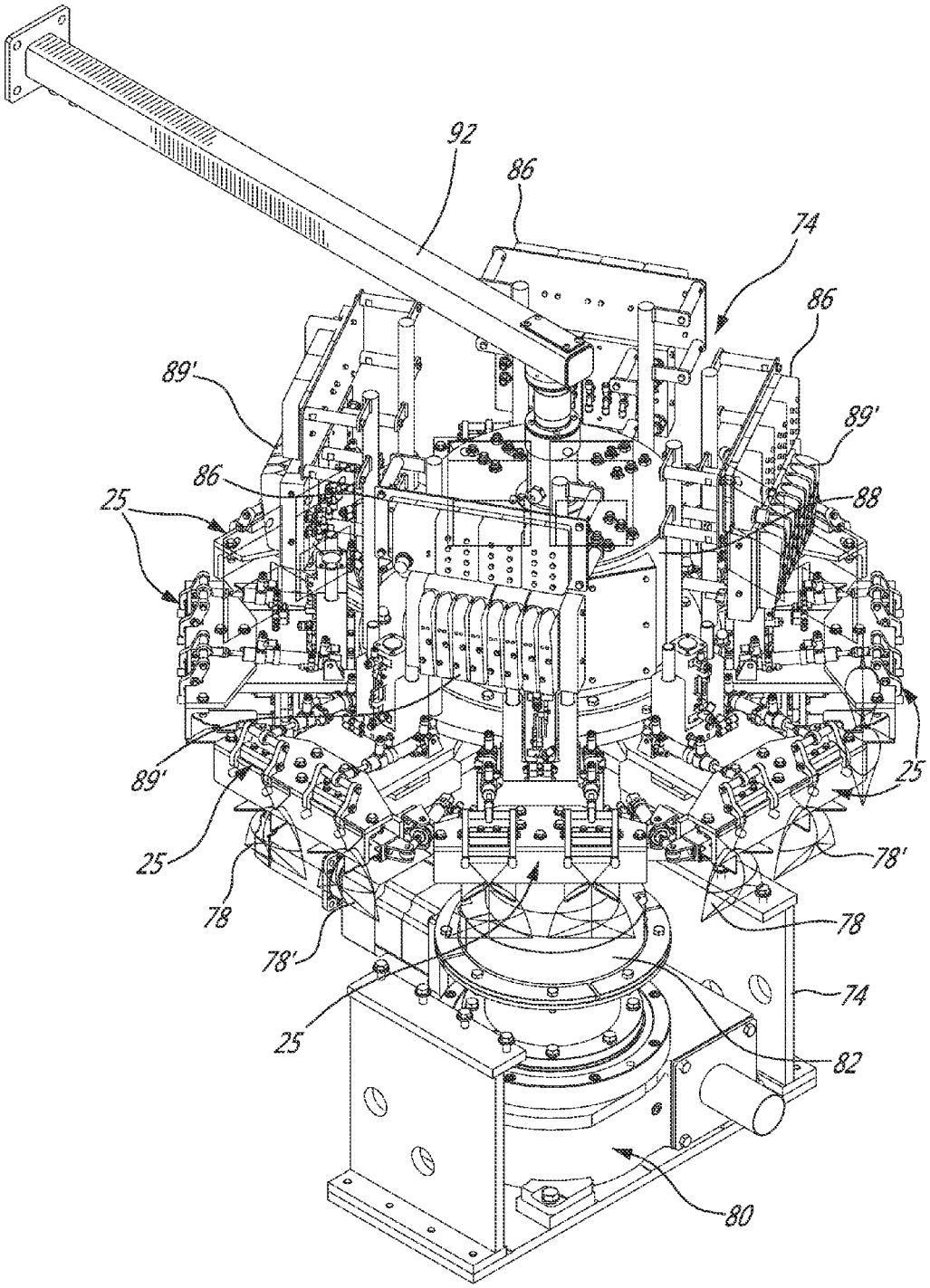
FIG. 8 is a perspective view of the conveyer provided on the handling system of FIG. 2.

Referring now to FIG. 1, there is shown a wicket bag handling system generally designated at 50 shown from rear and left sides thereof, in an embodiment adapted to bag filling operation whereby a product such as cheese curds fed to the system is bagged automatically at high speed. To provide protection for the operators when the system is running, the handling system is conveniently provided with a shielding fence 52 secured to the system frame 54, which fence being formed of a plurality of interconnected panels 56 to which protective plates 58 made of a shockproof material such as plexiglass are attached. In order to allow easy access to the system by the operator for maintenance, a number of door panels 56' are provided which are pivotally connected to the fixed panels 56 using hinges 60 and latches 62. As better shown in FIG. 2, a panel 56" is independently secured to the system frame 54 using a mounting arm 64 and sub-frame 65 to provide shielding with respect to a bag filling station that may be included in the system and incorporating a bag guiding device driven by an actuator 66 protruding through an opening 68 in plate 58', which device and station will be described below in detail. As also shown in FIG. 2, the frame 54 of the system 50 is conveniently mounted on a set of wheels 70 for allowing transport and positioning of the system to a desired operating location, which may typically depend on the specific position of the product feeding source. For example, the system 50 may be positioned under a product weighing system (not shown) so that the inlet of the bag filling station is aligned with an outlet of the product weighing system. Secured to the frame 54 is a main platform 72, at a central portion of which is mounted a conveyer generally designated at 74, in the form of a carousel mounted for rotation about a central vertical axis 76 for transporting wicket bags 78, 78' above the main platform 72 to one or more working positions along the transport path of the conveyer 74, where are disposed one or more working stations secured at the periphery of main platform 72, which stations are described in detail below. While a carousel has been conveniently used in the present embodiment for transporting the wicket bags 78, 78' along a circular path, a conveyer of any other appropriate design such as linear and reciprocal type may be also used depending on the application contemplated. As shown in FIG. 8, the conveyer 74 includes a servo motor-driven indexing unit 80 mounted on the system frame 54 below the platform 72 using a sub-frame 74, which indexing unit 80 is operatively coupled to a conveyer rotor 82 on which are secured for rotation therewith a plurality of wicket bag holders 84 as also shown in FIG. 3, provided on the conveyer 74 to transport each one of wicket bag 78, 78' to the working positions. Vertically disposed onto the rotor 82 are electrical connection and power supply units 86 and a pneumatic supply unit 88 connected to pneumatic distributors 89' and through which unit 88 a rotor end 90 extends, which is mounted for rotation to an overhead arm 92 secured to the system frame 54 and acting as a stator.

Figure 4:
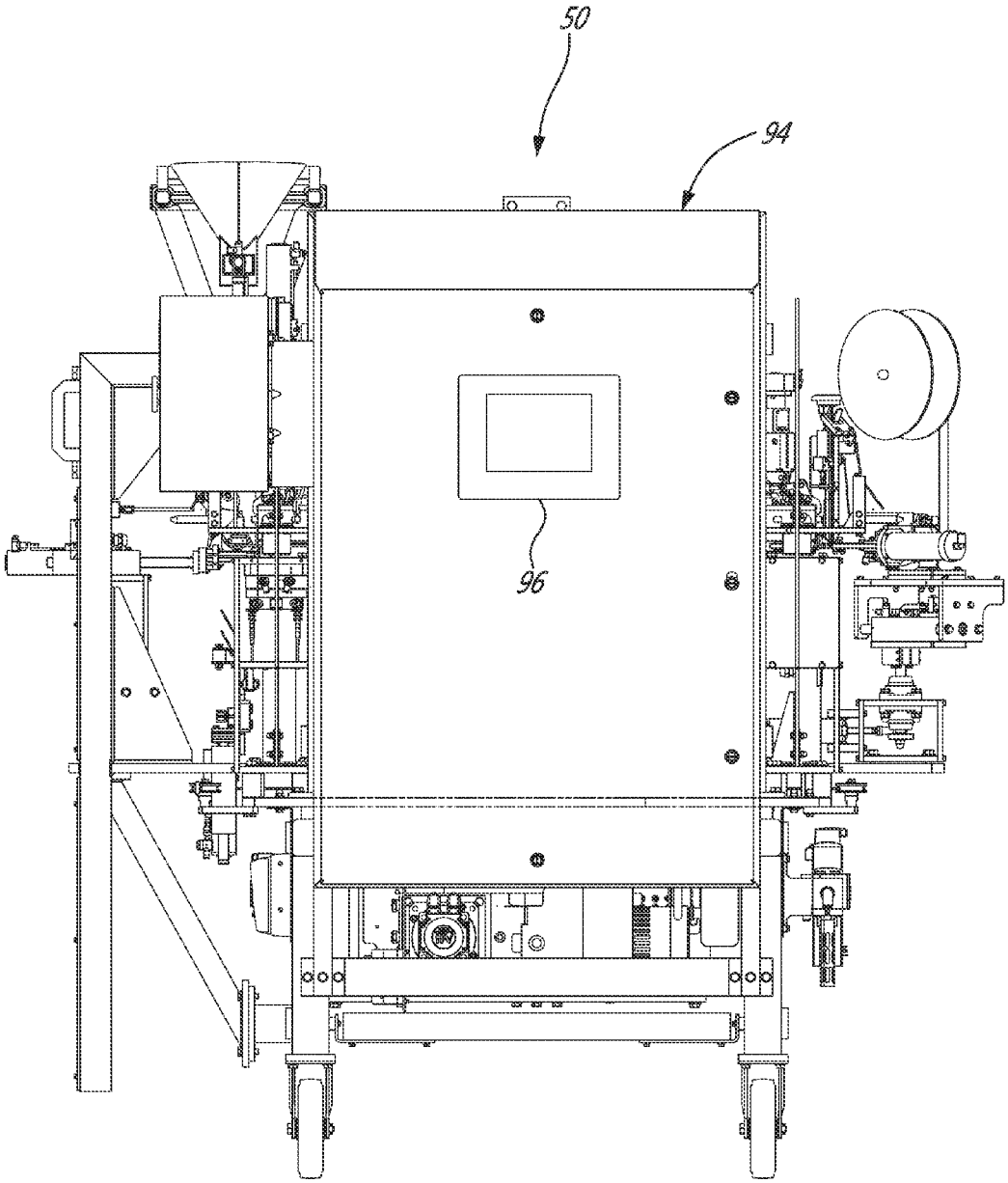
FIG. 4 is a front end view of the wicket bag handling system of FIG. 2
Figure 5:
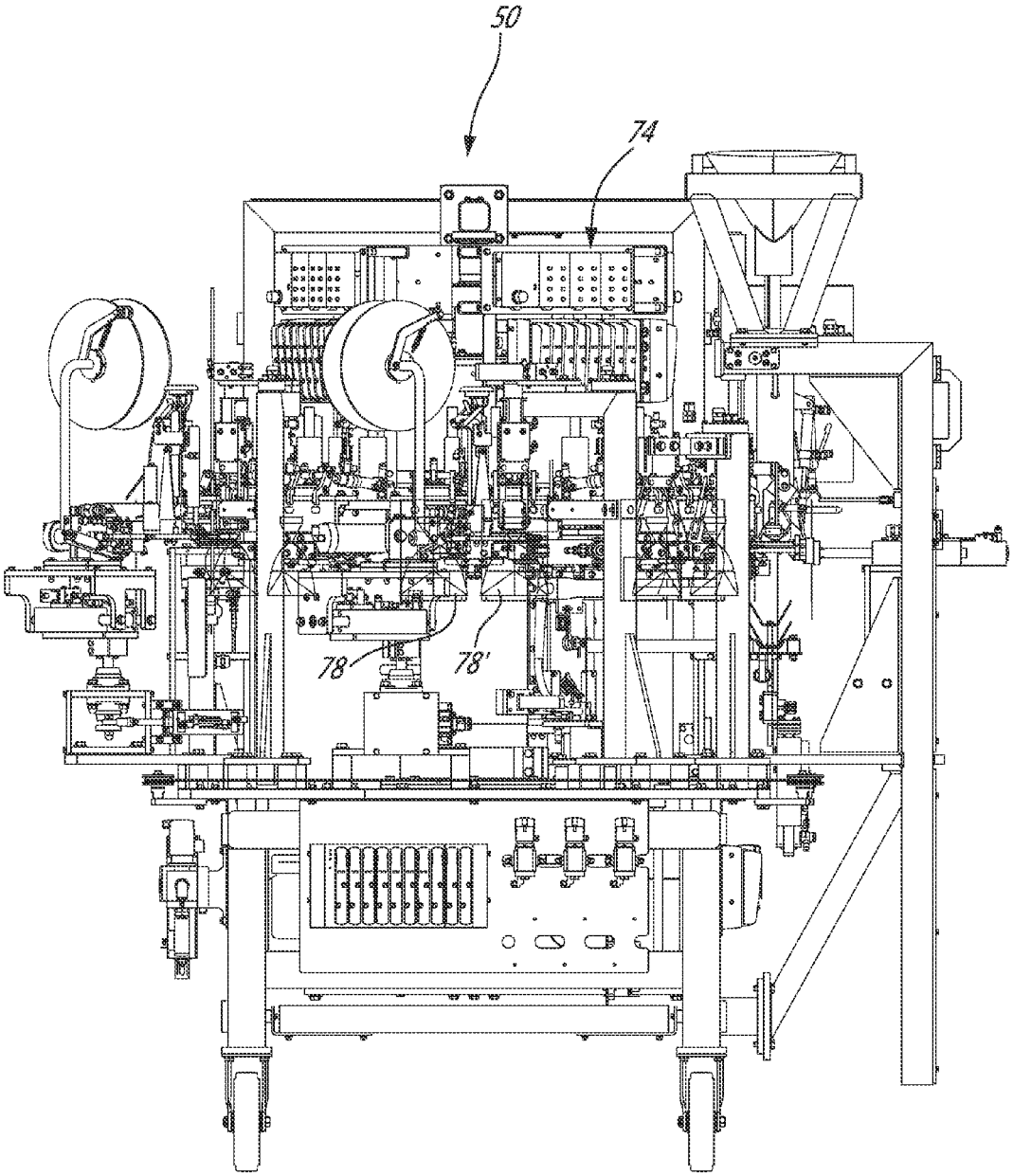
FIG. 5 is a rear end view of the wicket bag handling system of FIG. 2.
Figure 6:
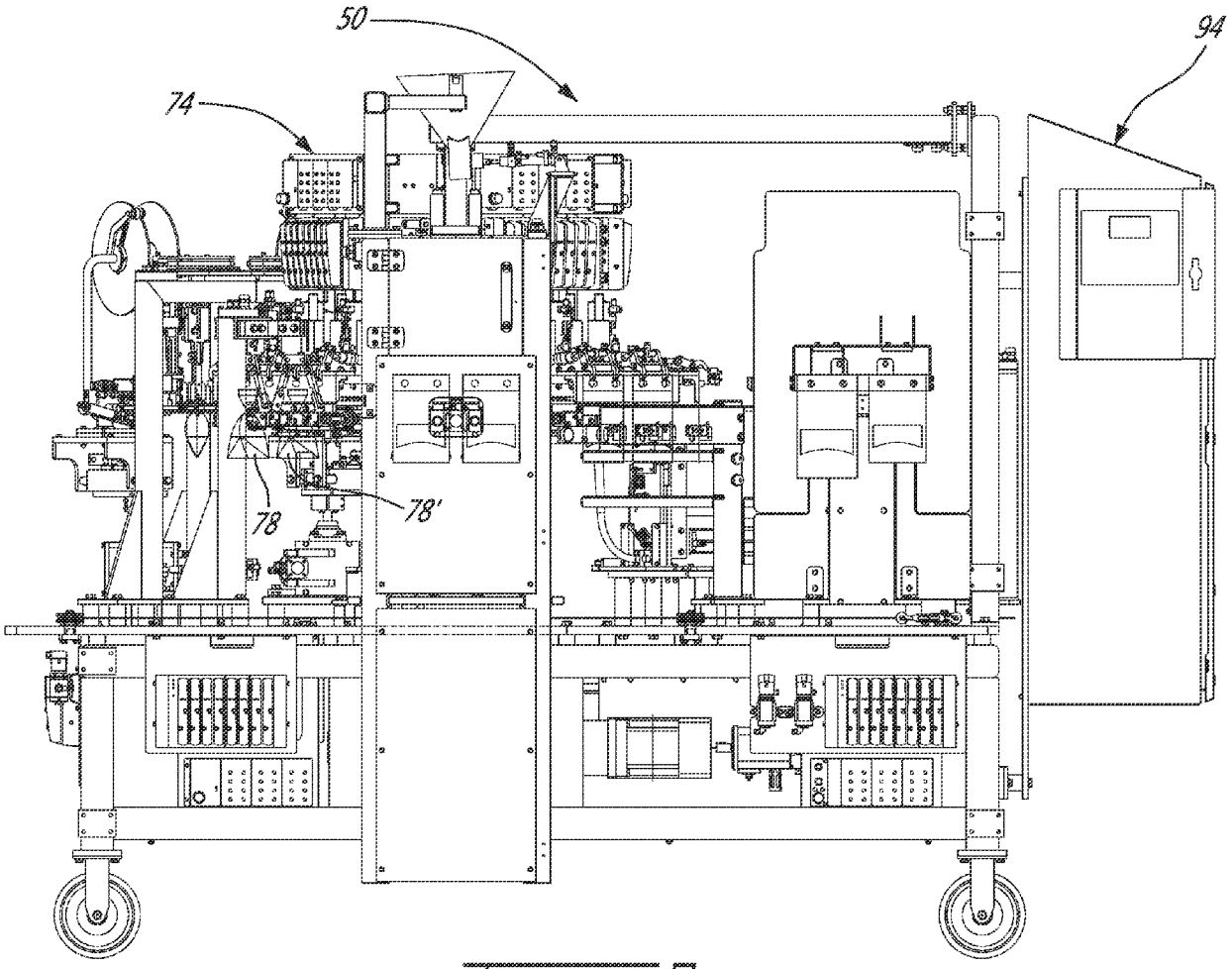
FIG. 6 is a left side view of the wicket bag handling system of FIG. 2.
Figure 7:
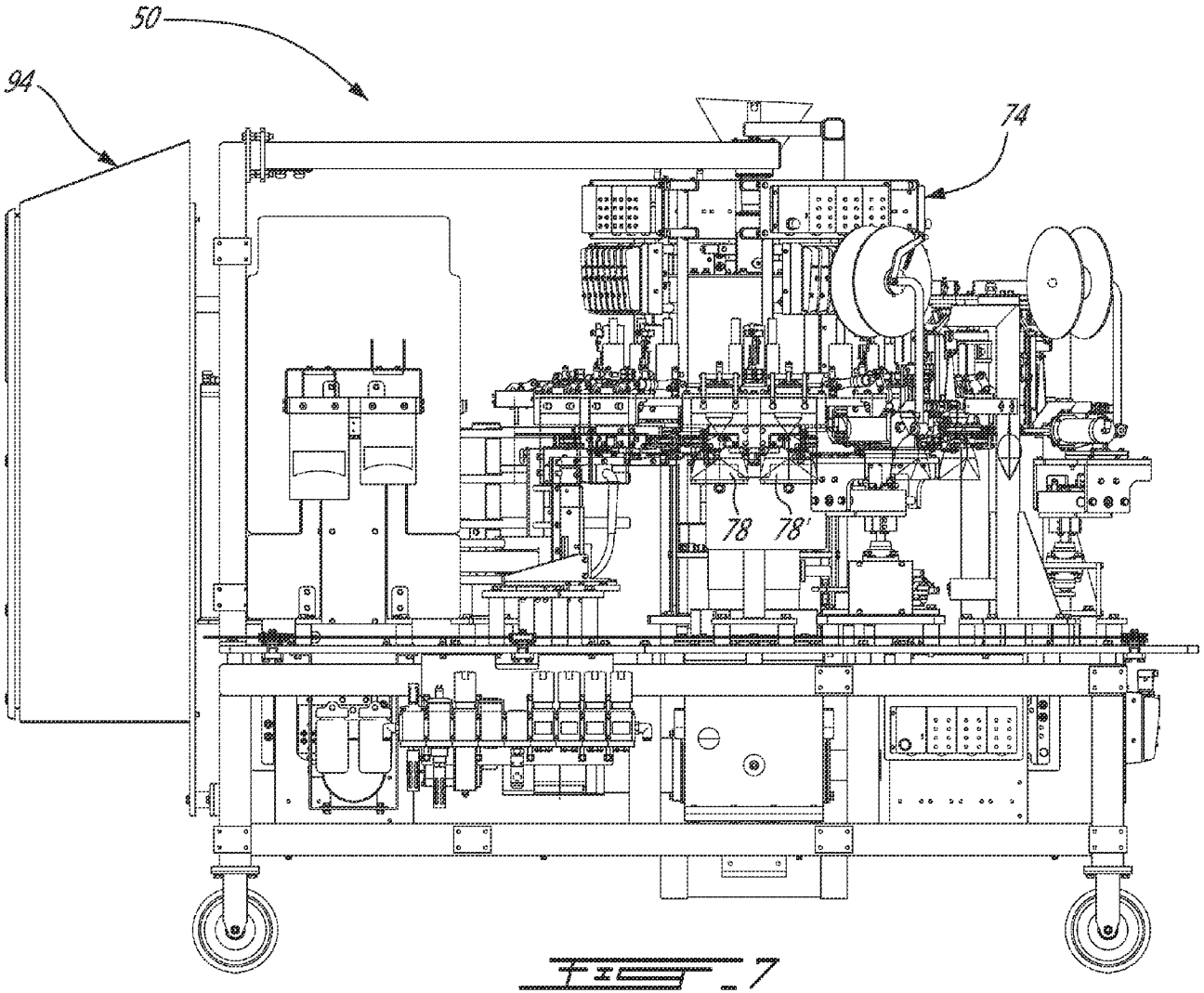
FIG. 7 is a right side view of the wicket bag handling system of FIG. 2.

The system 50 further includes a controlling device that may be a programmable logic controller such as Compact Logic series from Rockwell Automation-Allen Bradley (Milwaukee, Wis., USA) included in control unit 94 operatively connected to the conveyer 74 and provided with a display 96 as part of the operator interface as shown in FIG. 4, such as model HMI2055 interface also from Rockwell Automation-Allen Bradley. The control unit is programmed to command through pneumatic distributors 89, 89' all pneumatic mechanisms as well as electrically powered devices provided on the handling system that will be described below, and to receive all signals generated by sensors that may be required to operate the system.

Figure 9:
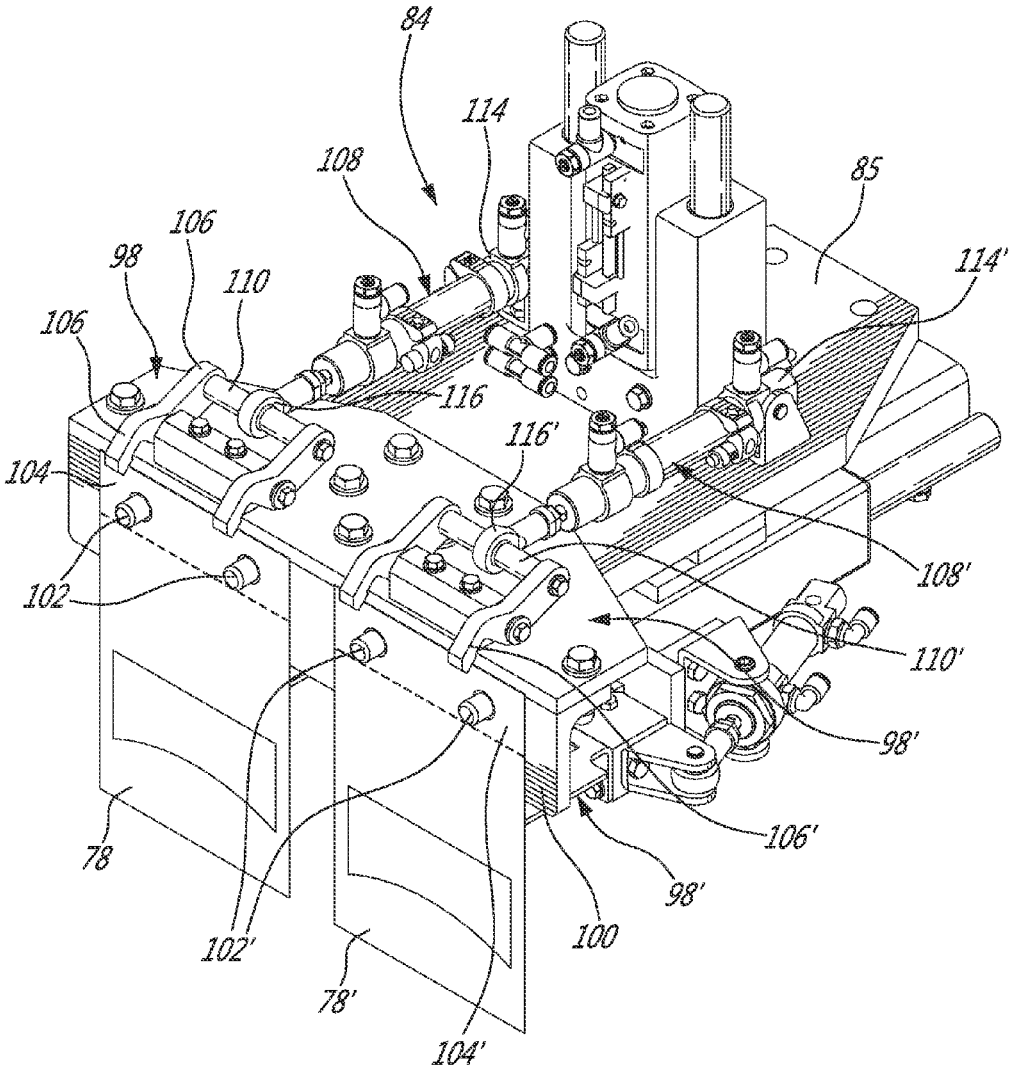
FIG. 9 is a perspective view of a bag holder provided on the conveyer of FIG. 8, shown with its holding devices in open position for receiving wicket bags.

Referring now to FIG. 9, each bag holder 84 has a head plate 85 secured to the conveyer rotor 82, and in the embodiment shown, each wicket bag holder 84 is capable of transporting first and second wicket bags 78, 78' by including a pair of holding device 98, 98' sharing a bag suspending element 100 provided with a plurality of pins 102, 102' acting as wickets, capable of engaging a plurality of corresponding holes provided on each wicket bag upper tab 104, 104'. The holding device 98, 98' further have respective locking elements 106, 106' coupled to driving mechanisms 108,108' including lever assemblies 110, 110' pivotally connecting the locking elements 106, 106' to the holder head plate 85, by means of linear displacement actuators 112, 112' provided on the driving mechanisms 108,108'. The actuators 112, 112' may be of a pneumatic type having respective bases 114, 114' operatively coupled to the head plate 85 and working ends 116, 116' operatively coupled to lever assemblies 110,110'. It can be appreciated from FIG. 9 in view of FIG. 10 that the holding devices 98, 98' can be operated by means of proper activation of driving mechanisms 108,108', between an open position as shown in FIG. 9 allowing receipt of upper tabs 104, 104' provided on wicket bags 78, 78', and a closed position whereby the bags as shown in FIG. 10, retained in position by locking elements 106,106' cooperating with the bag suspending element to grip the bags therebetween, are held suspended within a working zone 118 at the working position, as will be explained later in more detail in view of FIGS. 18 to 25.

Figure 10:
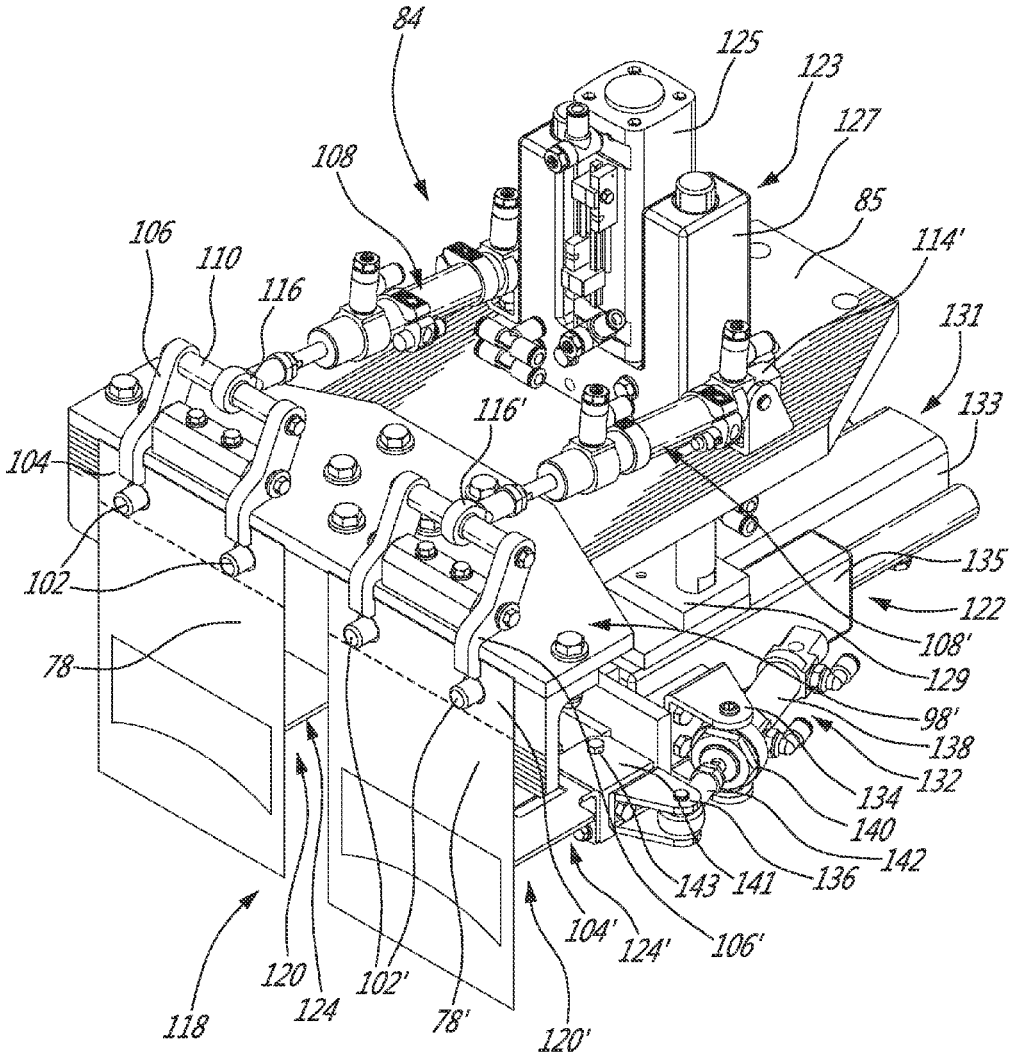
FIG. 10 is a perspective view of a bag holder provided on the conveyer of FIG. 8, shown with its holding devices in closed position for holding the wicket bags.
Figure 11:
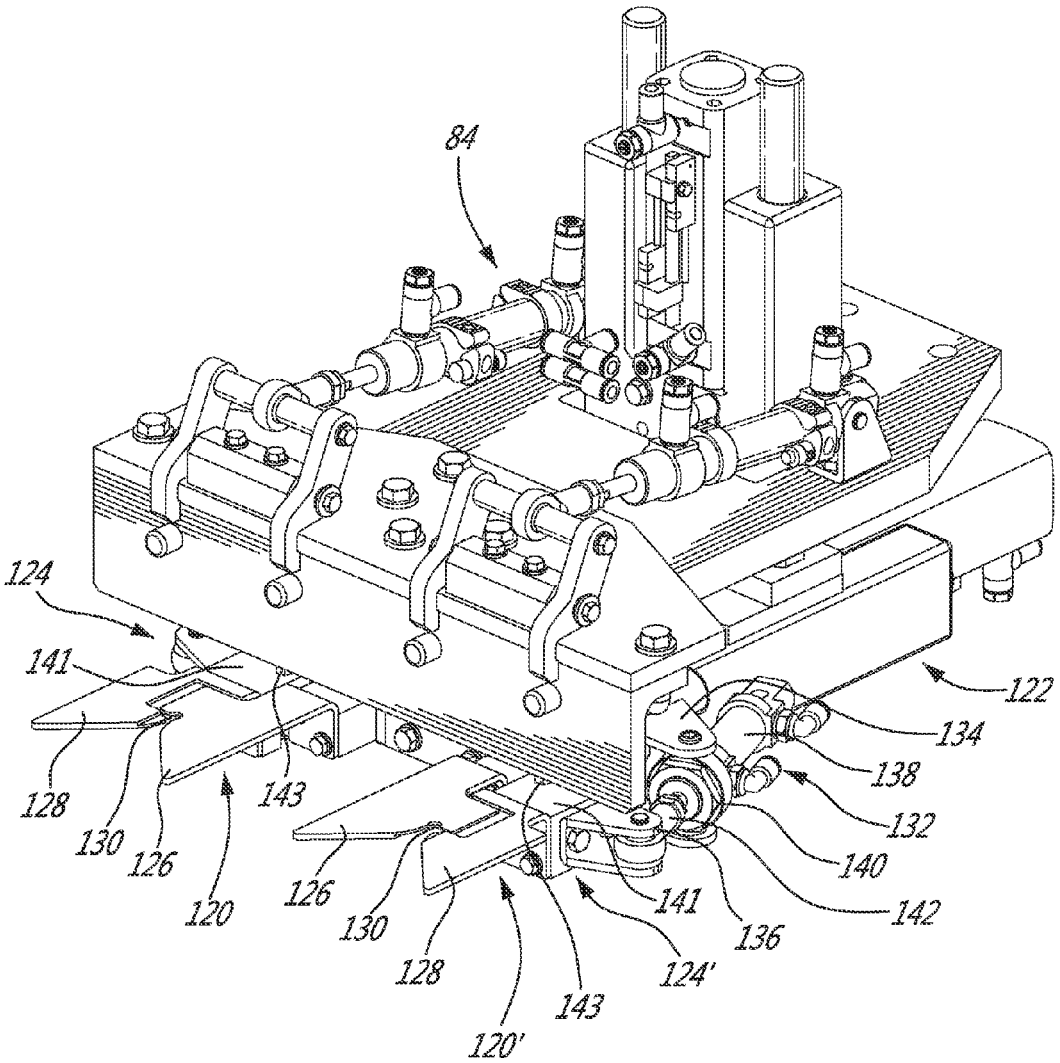
FIG. 11 is a perspective view of a bag holder provided on the conveyer of FIG. 8, represented without wicket bags to show the main gripping devices in open position.
Figure 12:
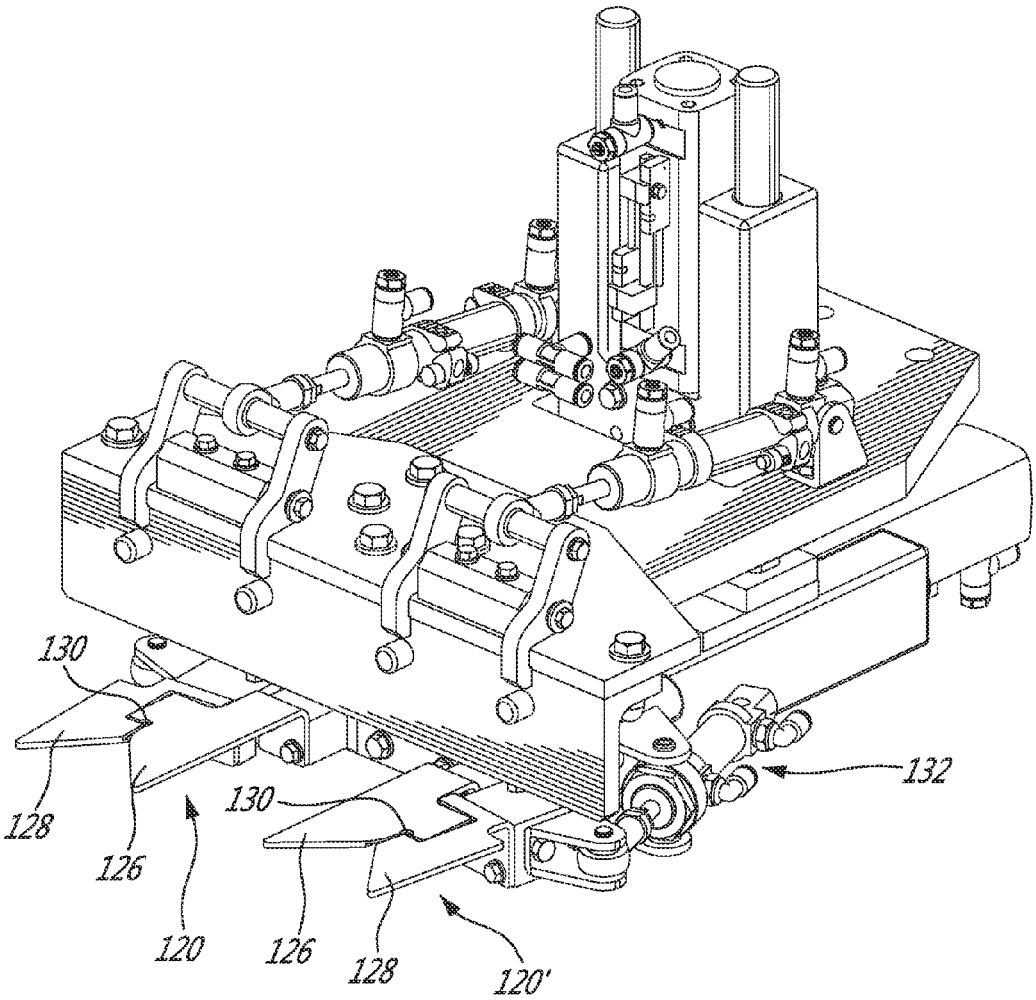
FIG. 12 is a perspective view of a bag holder provided on the conveyer of FIG. 8, represented without wicket bags to show the main gripping devices in closed position.

As shown in FIG. 10 in view of FIG. 11, the wicket bag holder 84 includes in the present embodiment a pair of main gripping devices 120, 120', each being coupled to a mechanical arrangement 122 for bringing thereof toward the working zone 118, which includes a first driving mechanism 123 used to displace the main gripping devices 120, 120' relative to the holding devices 98, 98'. The first driving mechanism 123 includes a first pneumatic linear displacement actuator 125 having a base 127 operatively coupled to the holder head plate 85 and a working end 129 operatively coupled to the main gripping devices 120, 120', through a second driving mechanism 131 included on the mechanical arrangement 122, which is used to bring the main gripping devices 120, 120' toward the working zone 118 by displacing the main gripping devices within a substantially horizontal plane. In the present embodiment, the second driving mechanism 131 is coupled to the first driving mechanism 123 so as to be displaced concurrently with the main gripping devices 120, 120' relative to the holding devices 98,98'. For so doing, the second driving mechanism 121 includes a second pneumatic linear displacement actuator 133 having a base 135 operatively coupled to the working end 129 of the first linear displacement actuator, and a working end 137 operatively coupled to the main gripping device 120, 120'. As better shown in FIG. 11, the main gripping devices 120, 120' includes respective pair of grip assemblies 124, 124' each having a stationary grip element 126, and a movable grip element 128, which elements 126, 128 are shaped one relative to the other to define a recess 130 for receiving a suspended wicket bag at a main gripping level. As better shown in FIG. 10, each movable grip element 128 is coupled to a driving mechanism 132, and is mounted on a bracket 141 adapted to pivot about axle 143 so as to cooperate with the stationary grip element 126 to grip the suspended wicket bag within the recess 130 upon operation of the driving mechanism 132. Each one of main gripping devices 120, 120' is coupled to the mechanical arrangement 122 through a mounting member 134, and a lever assembly 136 is provided on the driving mechanism 132 to connect the movable grip 128 element to the mounting member 134, through a pneumatic linear displacement actuator 138 having a base 140 operatively coupled to the mounting member 134 and a working end 142 operatively coupled to the lever assembly 136. It can be appreciated from FIG. 11 in view of FIGS. 12, 10 and 8 that each main gripping devices 120, 120' is operable between an open position as shown in FIG. 11 allowing receipt of a corresponding one of the suspended wicket bags 78, 78' at a main gripping level below the corresponding one of bag upper tab 104, 104', and above a fillable portion of the wicket bags, and a closed position as shown in FIG. 12 upon operation of the driving mechanism 132 whereby each bag 78, 78' is gripped to form a bag neck portion as shown in FIG. 8.

Figure 13:
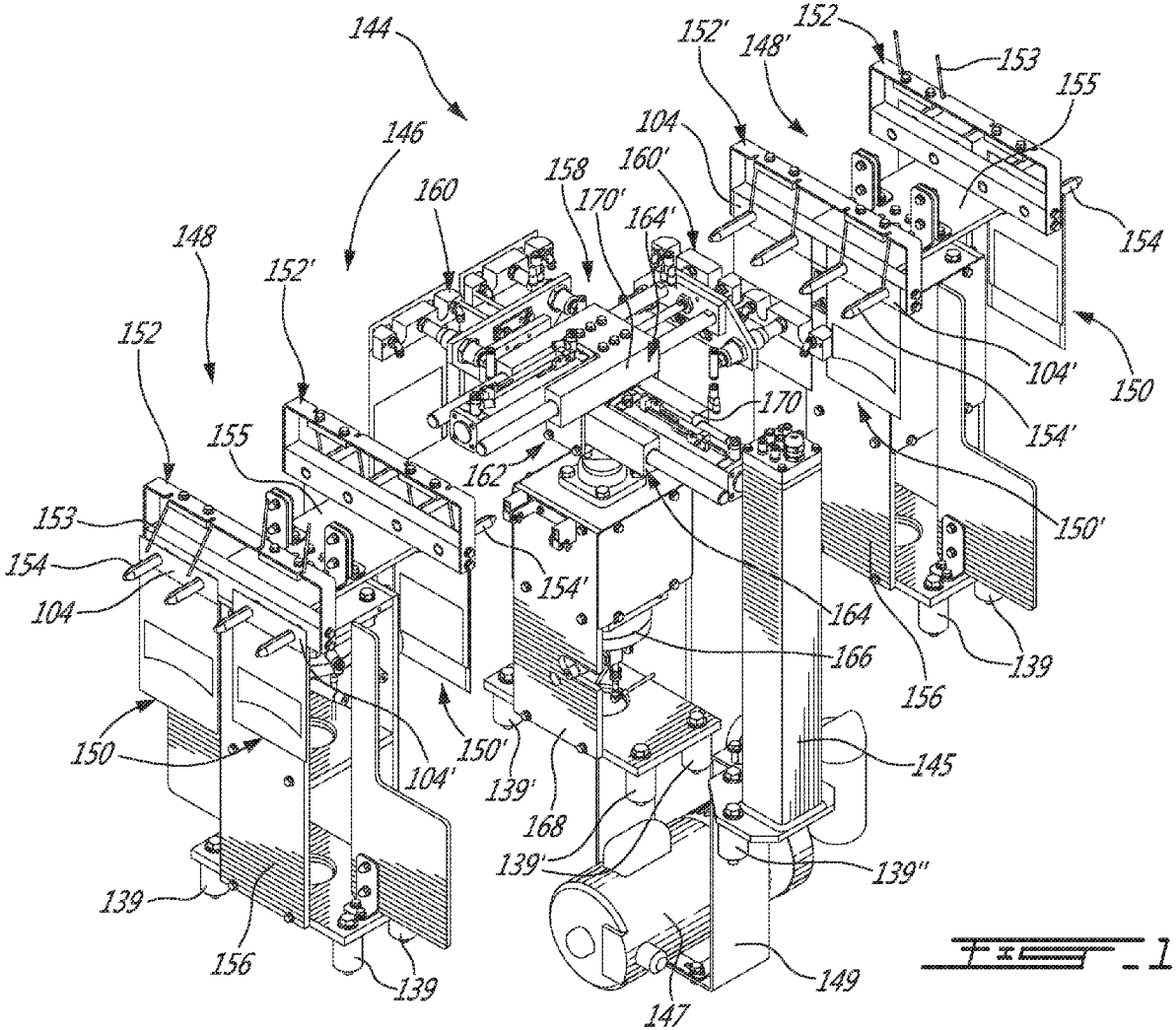
FIGS. 13 to 15 are perspective views of a wicket bag loading station provided on the handling system of FIG. 2, shown in various operating positions.
Figure 14:
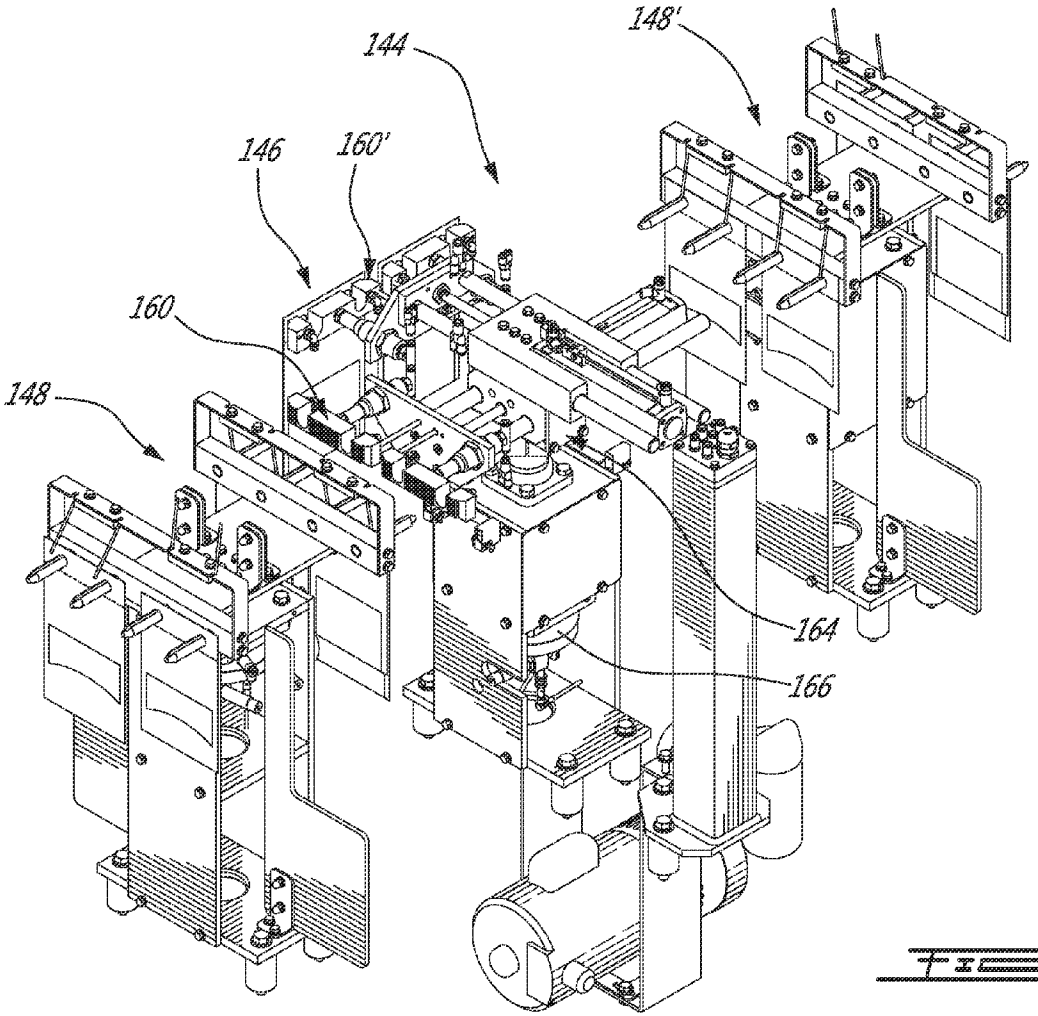
Figure 15:
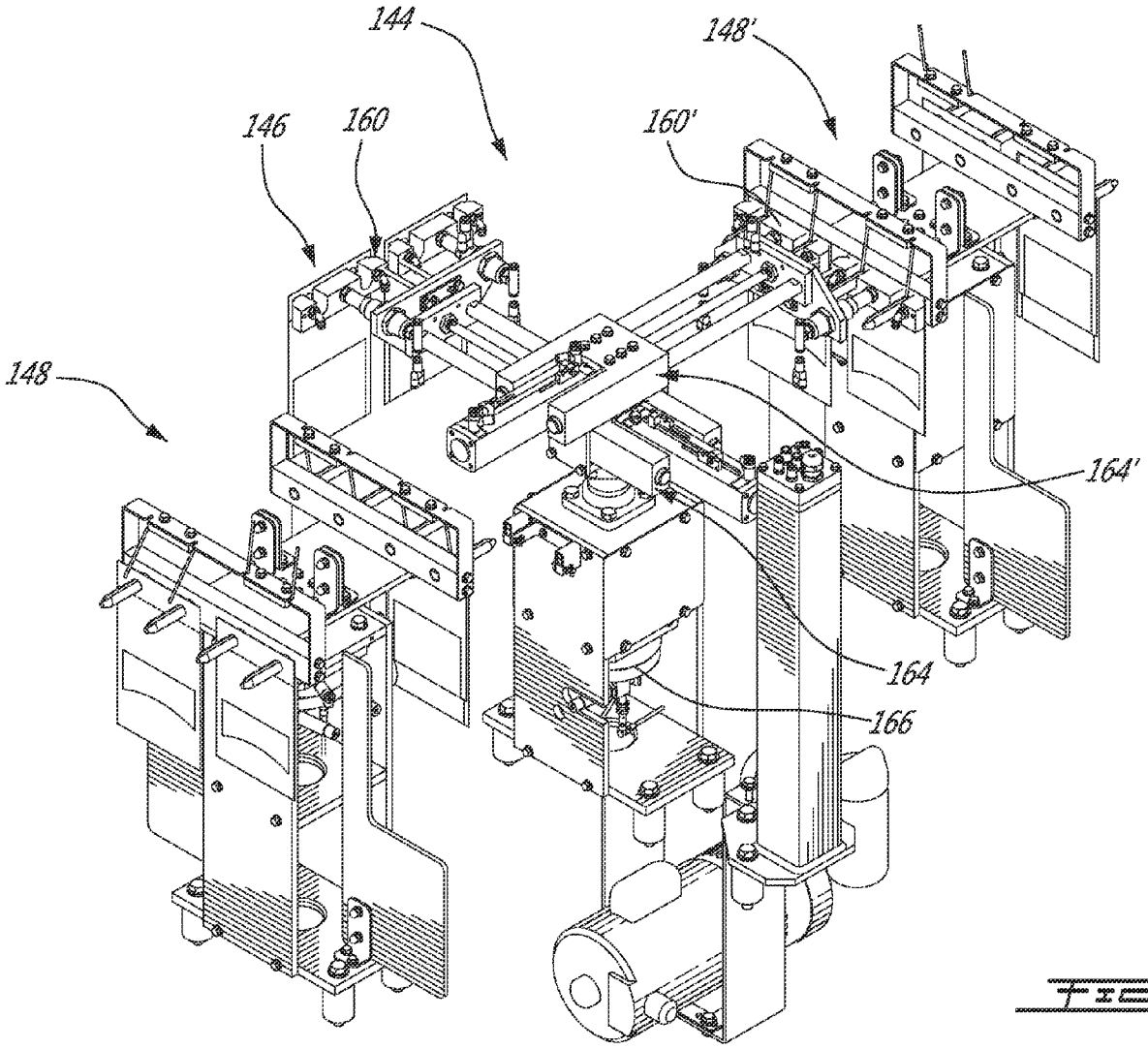

Turning now to FIG. 13, a wicket bag loading station that may be included in the bag handling system will now be described. The bag loading station 144 is operatively connected to the system controller, is located at a position as shown in FIG. 3 upstream the working position referred to above in relation with the conveyer 74, and defines a loading zone 146. The wicket bag loading station 144 includes one or more wicket bag magazines 148, 148' adapted to be mounted on the main platform of the system using bolt assemblies 139, each of which magazines may be adapted to carry one or more stacks of wicket bags, and more specifically two pairs of stacks 150, 150' in the present embodiment, by means of wicket bag supports 152, 152' provided with a plurality of pins 154, 154' acting as wickets, capable of engaging a plurality of corresponding holes provided on wicket bag upper tabs 104, 104' of the bags contained in each pair of stacks as maintained together with U-shaped springs 153. Conveniently, the supports 152, 152' provided on each one of magazines 148, 148' are mounted on a rotating platform 155 as part of a turntable 156 in parallel spaced opposed relationship, in such a manner than when one of the support 152 or 152' is brought to a bag feeding position through rotation of the platform 155 of turntable 156, the other support 152' or 152 is simultaneously brought to an outwardly facing position, allowing the operator to charge a next pair of stacks of wickets bags onto the available support, as can be appreciated in view of FIG. 2 showing support 152 facing outwardly. For providing high speed system operation, the bag loading station 144 also includes a wicket bag transfer unit 158 operable between a wicket bag pick-up position adjacent each one of wicket bag magazines 148, 148', and a wicket bag loading position adjacent the loading zone 146, where wicket bag holders 84, 84' as described above with reference to FIGS. 9 to 12, have their respective holding device 98, 98' in the open position allowing receipt of the wicket bag upper tabs. In the present embodiment, the first and second wicket bag magazines 148, 148' are disposed with respect to the wicket bag holders at the loading zone 146 in a predetermined angular relationship, i.e. 90° according to the present embodiment. The wicket bag transfer unit 158 includes first and second bag tab gripping devices 160, 160', conveniently using vacuum suction by means of a vacuum pump 147 adapted to be mounted under the system main platform through support 149, and pneumatically linked to the bag tab gripping devices 160, 160'. The bag tab gripping devices 160, 160' are coupled to a driving mechanism 162 having first and second corresponding pneumatic linear displacement actuators 164, 164' disposed one with respect to another according to the same predetermined angular relationship. The first linear displacement actuator 164 is sequentially operable from an extended position to a retracted position as shown in FIG. 14 to provide the wicket bag pick-up operation associated with the first wicket bag magazine 148 and the first bag tab gripping device 160, and is sequentially operable from the retracted position as shown in FIG. 13 to the extended position as shown in FIG. 15 to provide the wicket bag loading operation associated with the first wicket bag magazine 148 and the first bag tab gripping device 160. Reciprocally, the second linear displacement actuator 164' is sequentially operable from an extended position as shown in FIG. 15 to a retracted position as shown in FIG. 13 to provide the wicket bag pick-up operation associated with the second wicket bag magazine 148' and the first bag tab gripping device 160', and is sequentially operable from the retracted position as shown in FIG. 14 to the extended position to provide the wicket bag loading operation associated with the second wicket bag magazine 148' and the second bag tab gripping device 160'. The system controller is programmed to cause the first and second linear displacement actuators 164, 164' to perform their respective operation sequences alternatively. The driving mechanism 162 further has a rotary actuator 166 as part of a main turntable 168 also adapted to be mounted on the main platform using bolt assemblies 139', which turntable is operationally coupled to respective bases 170, 170' provided on the linear displacement actuators 164, 164', the latter being operable between two angular positions. In the first angular position as shown in FIG. 14, the first bag tab gripping device 160 is aligned with the first wicket bag magazine 148 in direction to the wicket bag pick-up position associated with the first wicket bag magazine 148, whereas the second bag tab gripping device 160' is aligned with bag holding devices (not shown) at the loading zone 146 in direction to the wicket bag loading position 146 associated with the second wicket bag magazine 148'. Reciprocally, in the second angular position as shown in FIGS. 13 and 15, the first bag tab gripping device 160 is aligned with other holding devices (not shown) at the loading zone 146 in direction to the wicket bag loading position associated with the first wicket bag magazine 148, whereas the second bag tab gripping device 160' is aligned with the second wicket bag magazine 148' in direction to the associated wicket bag pick-up position. Conveniently, the loading station 144 includes a post 145 adapted to be mounted on the system main platform using bolt assemblies 139", for receiving the electrical lines (not shown) coming from the control unit 94 as well as the pneumatic lines coming from one of the pneumatic distributors 89 provided on the handling system.

Figure 16:
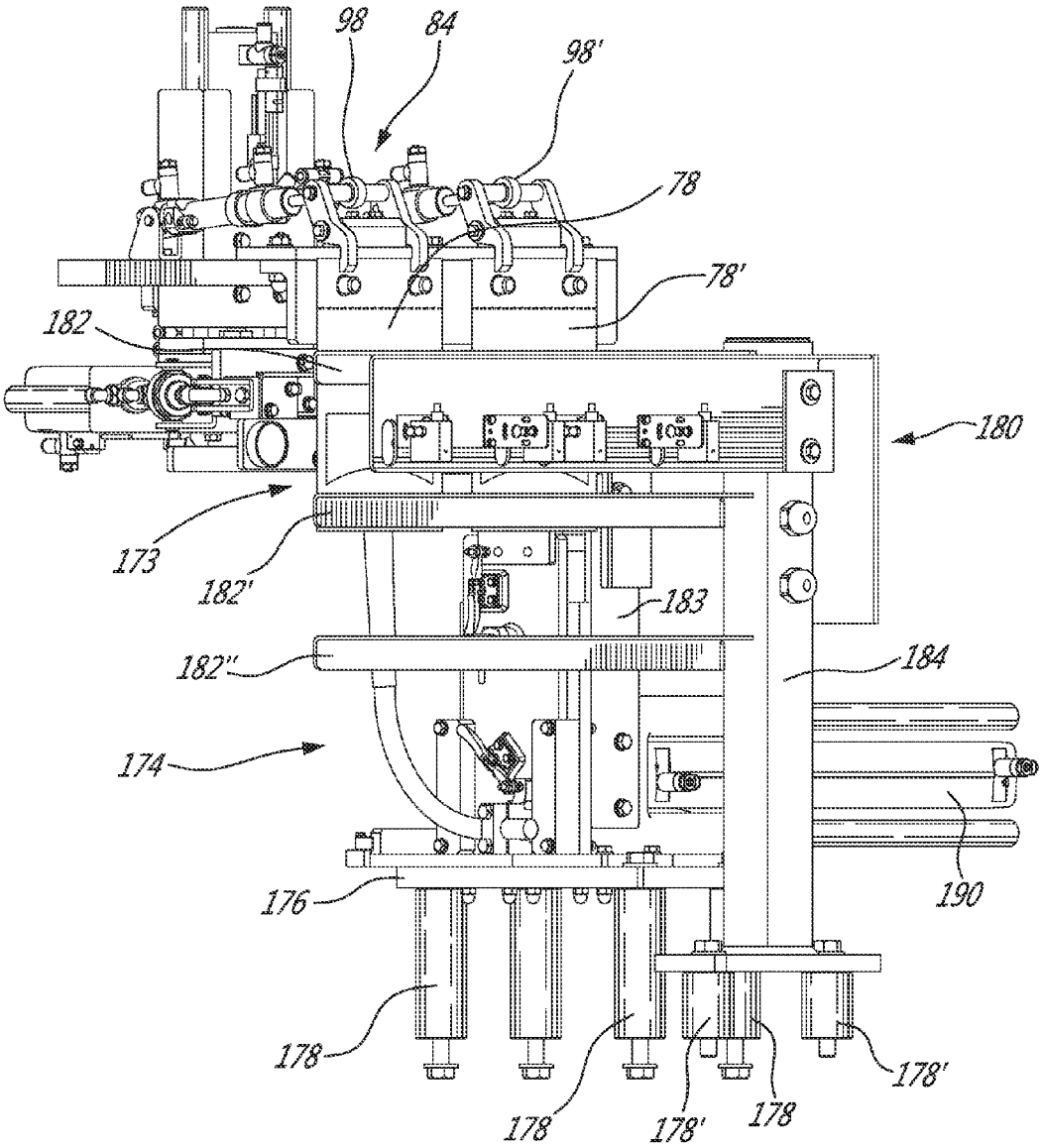
FIG. 16 is an elevation view of the bag printing station provided on the handling system of FIG. 2.
Figure 17:
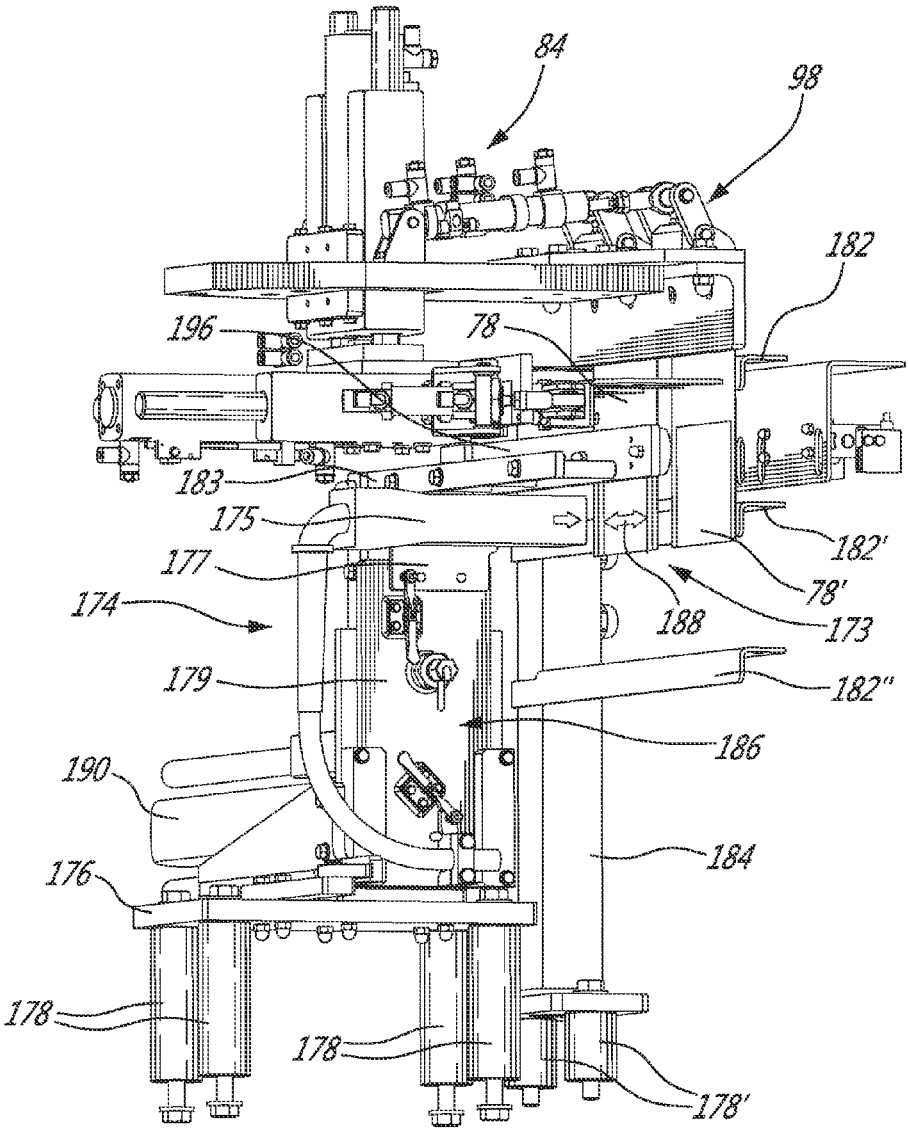
FIGS. 17 and 18 are perspective views of the bag printing station of FIG. 15, shown in various operation positions.
Figure 18:
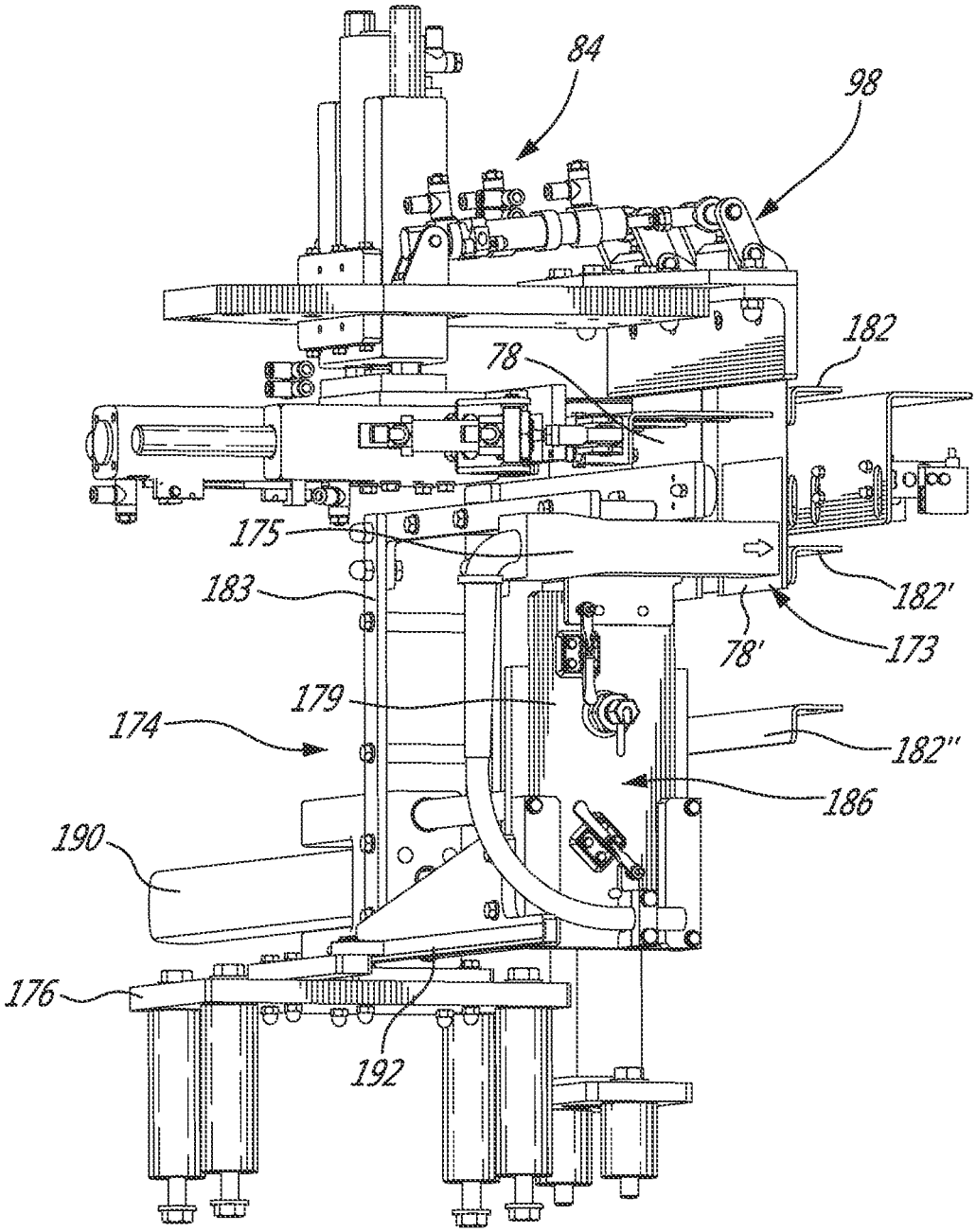

Turning now to FIG. 16 in view of FIG. 17, a wicket bag printing station that may be included in the bag handling system will now be described. The a wicket bag printing station 172 is operatively connected to the system controller trough a printer interface unit 95 shown in FIG. 1, is located as shown in FIG. 3 at a position upstream the working position referred to above in relation with the conveyer 74, and defines a printing zone 173. In the embodiment shown, the printing station 172 is located downstream the bag loading station 144, and includes a printing unit 174 having a base 176 adapted to be mounted on the main platform of the system using bolt assemblies 178, a frame 183 and a printing head shown in FIG. 17 which receives control data trough a from a cable 97 linked to the printer interface unit 175. A printing head model 9030 with its interface unit supply by Markem Imaje Inc. (Lachine, Quebec, Canada) can be used. The printing station 172 further includes a wicket bag guide 180 in the form of two elongated members 182, 182' extending horizontally in a parallel spaced relationship and secured on a post 184 adapted to be mounted on the system main platform using bolt assemblies 178'. It can be seen from FIG. 17 that the printing head 175 and the members 182, 182' of the wicket bag guide are disposed adjacent the printing zone 173 and in a spaced parallel relationship to define a channel therebetween for receiving a wicket bag onto which information is printed when it has been transported to the printing zone 173. In the present embodiment wherein each wicket bag holder 84 is capable of transporting first and second wicket bags 78, 78' by including corresponding first and second holding devices 98, 98' as described above, the printing unit 174 further includes a displaceable carrier 186 on which is mounted the printing head 175 using a flange 177 secured to a wall 179 as shown in FIG. 17, which is adapted to adjust the vertical position of the printing head 175 with respect to the base 176 by way of a key 182, in order to align the printing zone according to the size (i.e. length) of the wicket bags to be printed. Optionally, the wicket bag guide 180 may be provided with a further elongated member 182" that can be used to guide wicket bags of longer size. The carrier 186 is coupled to a pneumatic linear displacement actuator 190 for being operable to be displaced reciprocally with respect to base 192 and frame 183 using sliding member 192, from an initial position shown in FIG. 17, in a direction parallel to the bag receiving channel as indicated by arrow 188, so that the printing head is sequentially brought to a first position adjacent first wicket bag 78 onto which information (e.g. date of handling, product lot number) is printed as the printed head is travelling, and then brought to a second position as shown in FIG. 18 adjacent wicket bag 78 onto which similar information is printed. Optical detector such as photocells may be provided to verify if the bags are present or in proper position within the printing zone, by securing a detector holding member 194 to the post 184, and by securing a corresponding reflector holding member 196 to the printer unit frame 183.

Figure 19:
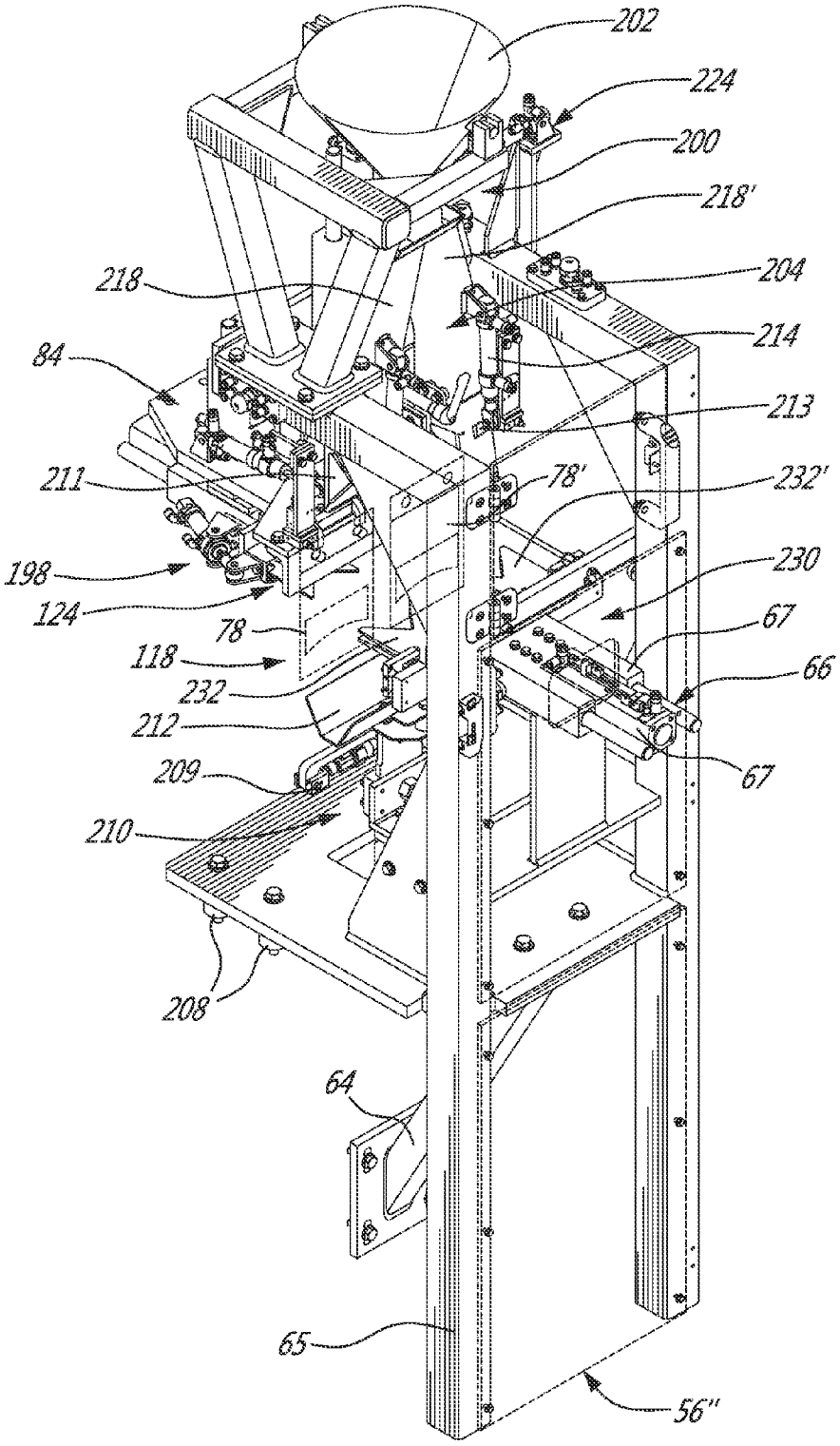
FIGS. 19 and 20 are perspective views of the bag filling station provided on the handling system of FIG. 2, respectively showing its inwardly and outwardly facing components.
Figure 20:
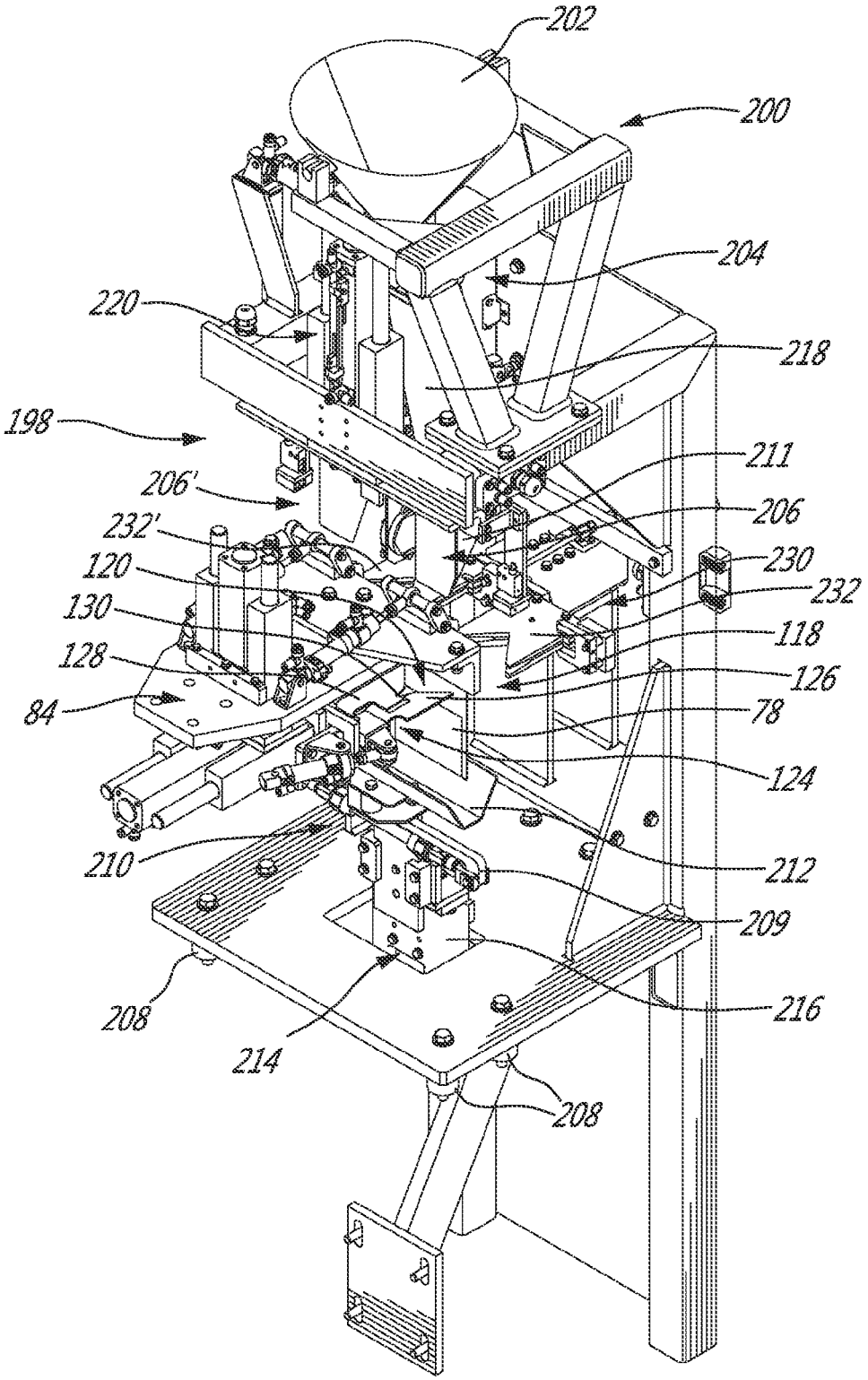
Figure 21:
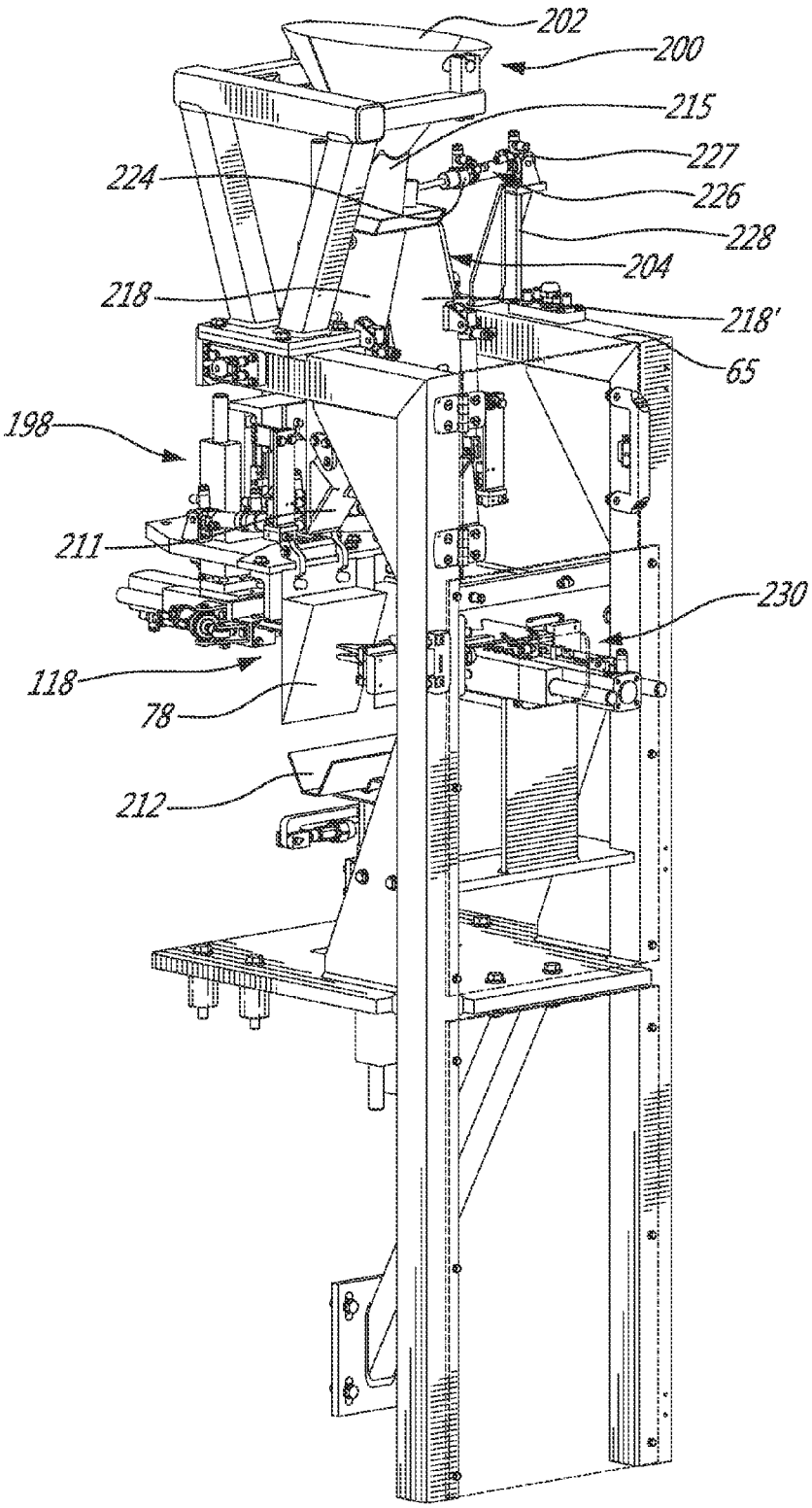
FIGS. 21 and 22 are respectively perspective view and rear end view of the bag filling station shown in a first mode of product distribution.
Figure 22:
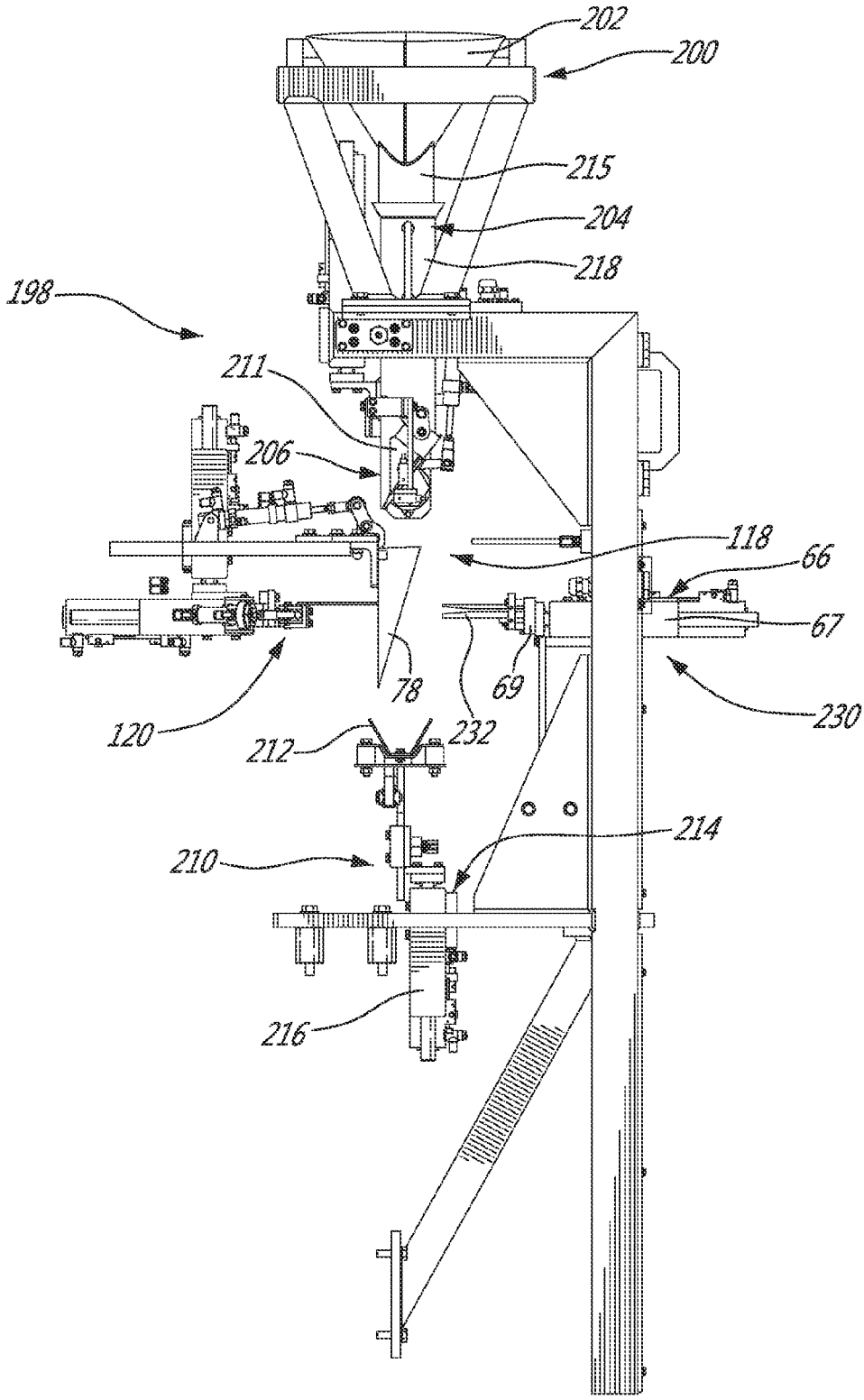
Figure 23:
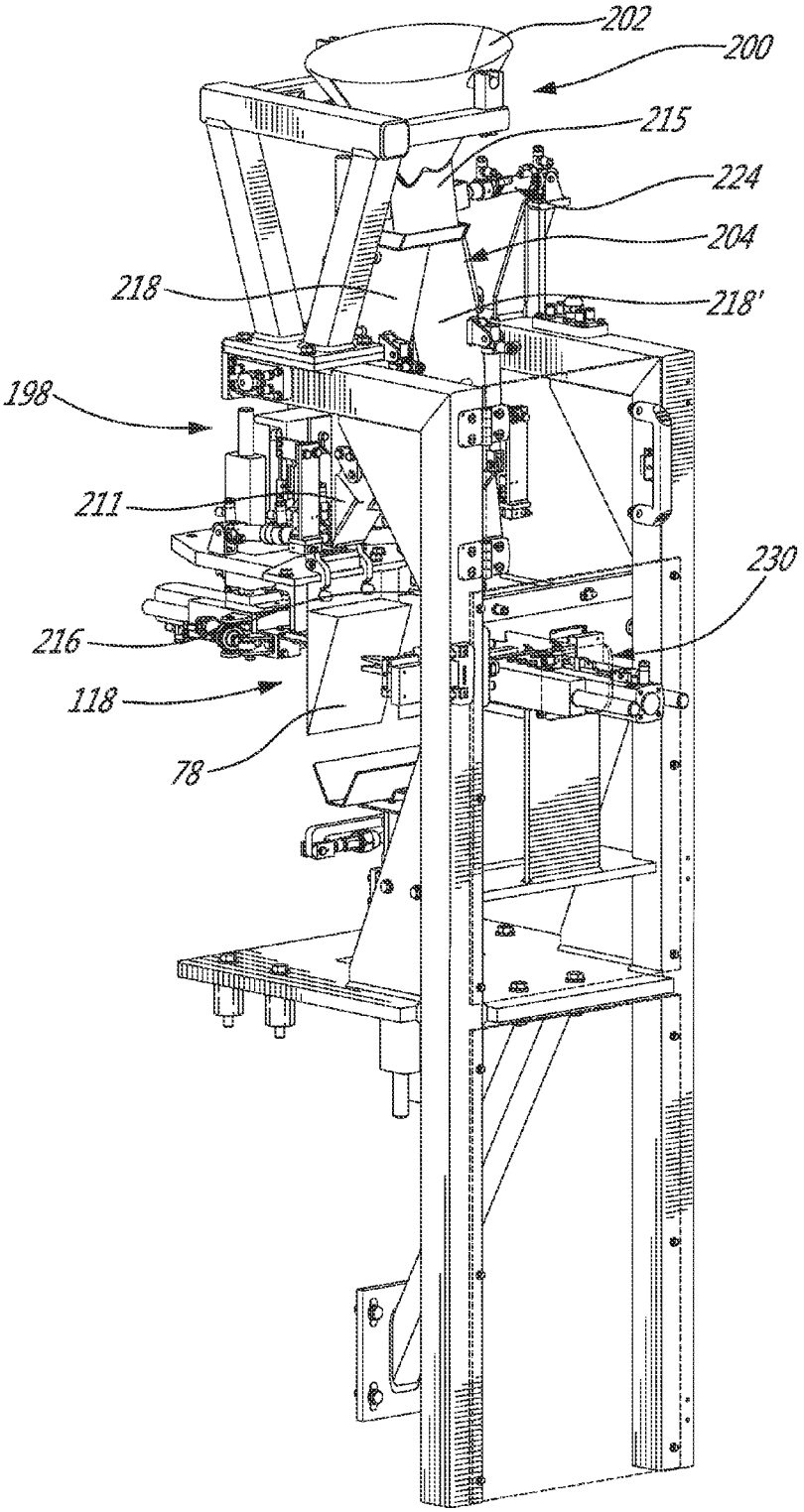
FIG. 23 is a perspective view of the bag filling station of FIGS. 21 and 22, shown in a second mode of product distribution.
Figure 24:
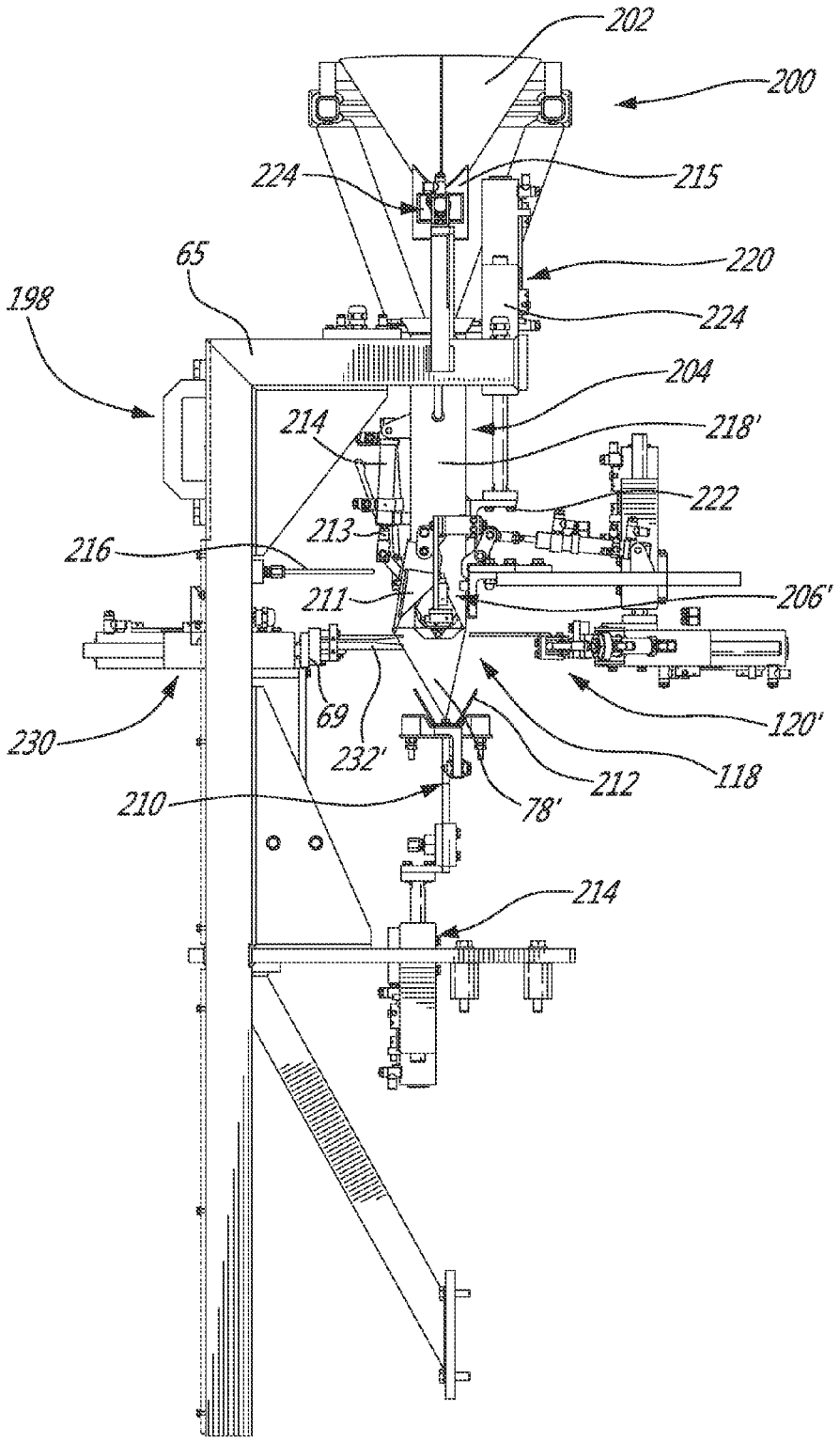
FIG. 24 is a front end view of the bag filling station of FIGS. 21 and 22, shown in a product discharging mode of operation.
Figure 25:
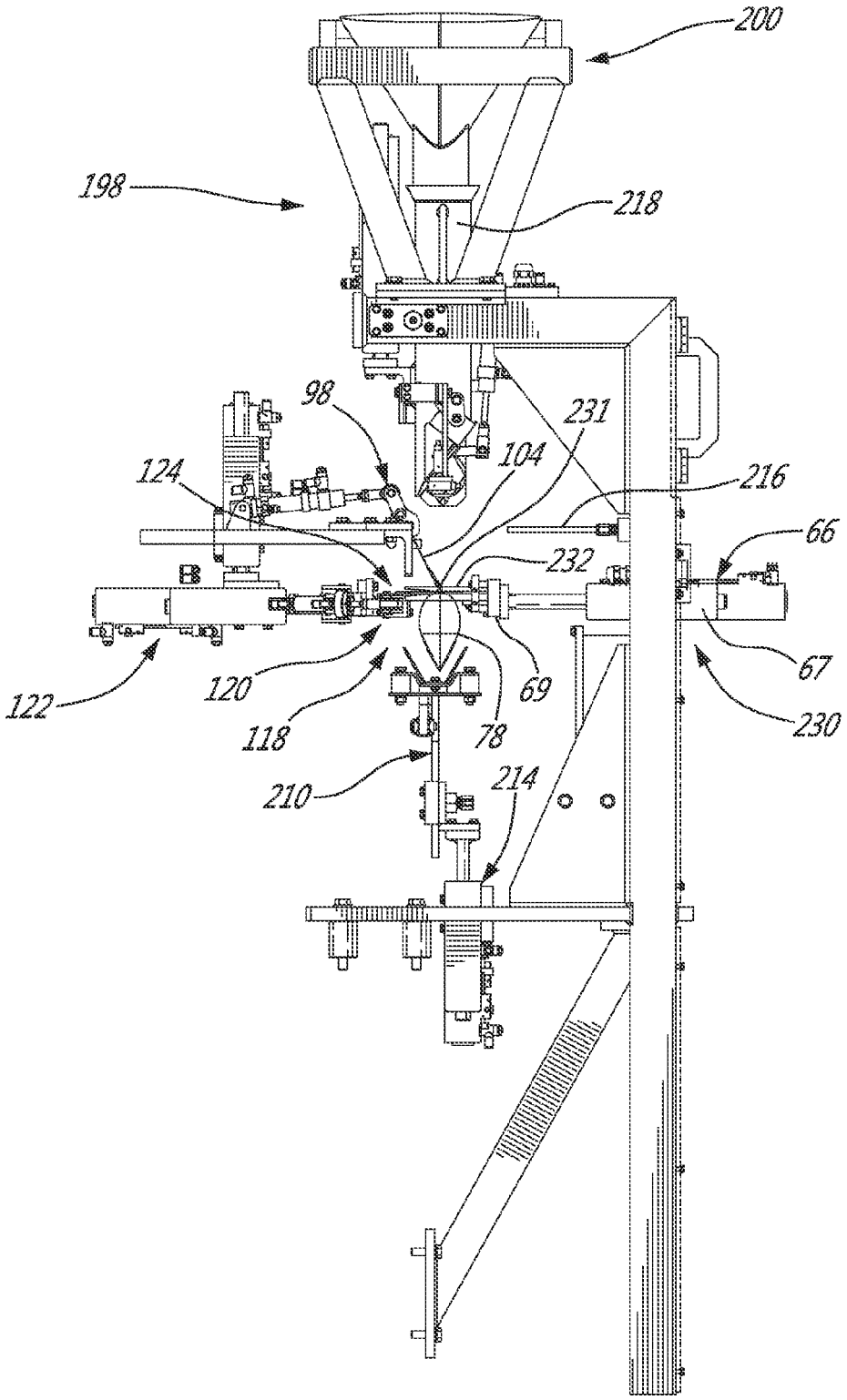
FIG. 25 is a rear end view of the bag filling station of FIGS. 21 and 22, shown in a filled bag gripping mode of operation to form a bag neck.
Figure 26:
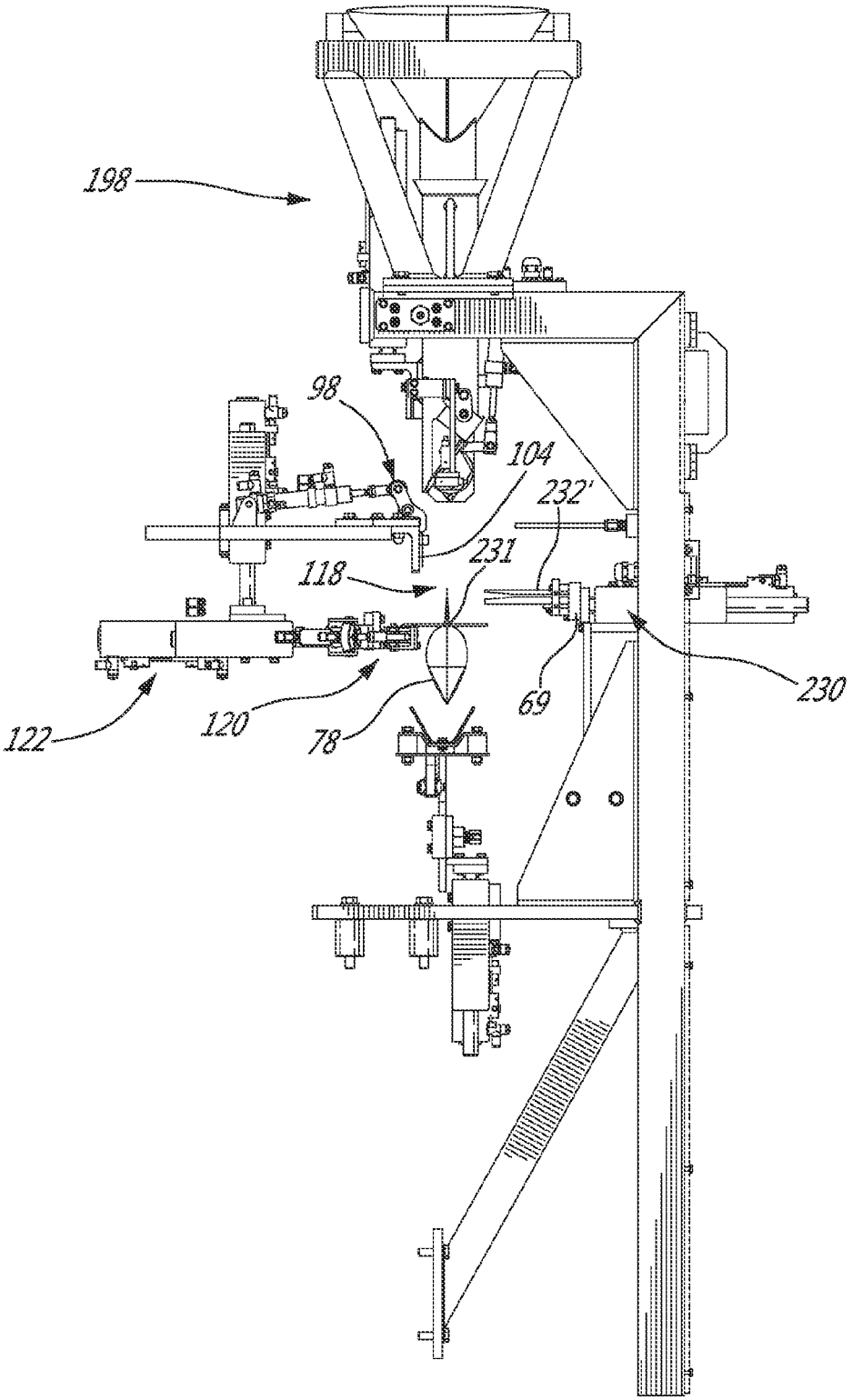
FIG. 26 is a rear end view of the bag filling station of FIGS. 21 and 22, shown after separation of a wicket bag from its upper tab.

Turning now to FIG. 19 in view of FIG. 20, a wicket bag filling station that may be included in the bag handling system will now be described. The wicket bag filling station 198 is operatively connected to the system controller, is located as shown in FIG. 3 at the working position referred to above in relation with the conveyer 74, and wherein the working zone is a bag filling zone 118. The wicket bag filling station 198 incorporates the sub-frame 65 secured to the system frame using mounting arm 64, and to which its components are attached, and a base plate secured to the main platform of the system through bolt assemblies 208. The filling station 198 basically includes a product distributing unit 200 having an inlet 202 in the form of a hopper for receiving a filling product (not shown) such as cheese curds, and a product discharging unit 204 having at least one or more outlets 206, 206' as shown in FIG. 20 being disposed above and in substantially vertical alignment with the bag filling zone 118 when each one of the wicket bags 78, 78' has been transported to the working position by the holder 84, to allow discharge of the product into the wicket bags 78,78'. Each one of outlets 206, 206' is provided with a trap 211 linked to a pivoting mechanism 213 coupled to the working end of a pneumatic linear displacement actuator having its base pivotally secured to the discharging unit 204 as better shown in FIG. 24. Each trap 211 is operable between a closed position as shown in FIGS. 21, 22 and 23 and an open position as shown in FIG. 24 allowing product discharge into the bags 78, 78'. Furthermore, as shown in FIG. 24, the product discharging unit 204 is coupled through a flange 222 to the working end of a pneumatic linear displacement actuator 220 having its base 224 secured to the sub-frame 65, in such a manner that the product discharging unit 204 is operable between an upper position as shown in FIGS. 21, 22 and 23 where the product discharging unit is in communication with the inlet unit 200 through a neck 215 provided on the lower part of the inlet 202, and a lower position as shown in FIG. 24 where the outlets 206 is in communication with a mouth portion of each one of wicket bag 78, 78' receiving the discharged product when the trap is operated to the open position. According to the present embodiment of handling system wherein each wicket bag holder 84 is capable of transporting first and second wicket bags 78 and 78', the product discharging unit 204 further has corresponding first and second product containers 218, 218' disposed above the first and second outlets 206, 206' as shown in FIG. 19 in view of FIG. 20, the product distributing unit being operable when brought at the upper position to sequentially transfer the received filling product to the first and second product containers 218, 218'. For so doing, as shown in FIG. 21, the inlet 202 inlet is coupled a pivoting mechanism 224 in the form of a pneumatic linear displacement actuator 226 having its base 227 secured to the sub-frame through vertical member 228 and having a working end pivotally secured to the neck 215 of the inlet 202. The pivoting mechanism 224 is selectively movable between a first position as shown in FIG. 21 where the inlet 202 is in communication with the first product container 218 and a second position as shown in FIG. 23 where the inlet 202 is in communication with the second product container 218', to provide the sequential transfer of the received filling product into the discharging unit 204. According to an optional design (not shown), there may be provided a transfer conduit stationary with respect to the sub-frame 65 having a product receiving upper end disposed below the inlet neck 215, and having two branches in sliding relationship with respective containers 218, 218' so as to receive the product as it is sequentially transferred to the containers 218, 218' by the distributing unit 200, and to allow the product discharging unit 204 to move between its upper position in communication with inlet unit 200, and its lower position where the outlets 206, 206' are in communication with respective mouth portions of the wicket bags 78, 78' for filling thereof. The wicket bag filling station further includes a vibrating bag support 210 having a tray 212 adapted to receive a bottom portion of each of wicket bags 78, 78', which tray 212 is mechanically coupled to a vibrator device 209 and to the working end of a pneumatic linear displacement actuator 214 having its base 216 secured to the base plate 207 to work within a vertical plane. The vibrating bag support 210 is operable between an upper position as shown in FIGS. 24 for supporting the wicket bag during product discharge while vibrating thereof to promote fast gab filling, and a lower position as shown in FIGS. 22 and 26 allowing transport of the wicket bag. The bag filling station 198 may also be provided with an air jet device 216 as better shown in FIG. 24 for opening a mouth portion of the wicket bag prior to receive the discharged product. As mentioned above in view of FIG. 2, a bag guiding device is included in the handling system as part the bag filling station 198 in the present embodiment. The bag guiding device generally designated at 230, is mounted to the sub-frame 65 to be disposed in substantially horizontal alignment with the bag filling zone 118 when each of wicket bags 78, 78' has been transported to the working position. As shown in FIGS. 19 and 20 in view of FIG. 25 the bag guiding device 230 includes first and second guide elements 232, 232' each being of a proper shape, such as a generally V-shape, adapted to confine the engaged portion of a corresponding one of wicket bags 78, 78' toward the recess 130 defined by the grip elements 126, 128 provided on the grip assemblies 124, 124' of main gripping devices 120, 120' as described above in view of FIGS. 10 and 11. The bag guiding device is provided with a driving mechanism in the form of a pneumatic linear displacement actuator 66 having its base 67 secured to the sub-frame 65 and having a working end 69 coupled to the guide elements 232, 232', so that the guiding device 230 is operable between a bag engaging position as shown in FIG. 25 to direct each one of the suspended wicket bags 78, 78' after filling toward the corresponding main gripping devices 120, 120' and to cooperate therewith to form the bag neck portion 231, and a bag releasing position as shown in FIG. 26 allowing transport of the wicket bags 78, 78'. Each one of guide elements 232, 232' is formed of an upper part and a lower part defining a channel for receiving the corresponding one of grip assemblies 124, 124' in overlapping relationship therewith when the bag guiding device 230 is operated to the bag engaging position shown in FIG. 25. It can be appreciated from FIG. 25 that the upper tabs 104, 104' provided on wicket bags 78, 78' are retained by the holding devices 98, 98' after forming of the bag neck. In the present embodiment, the mechanical arrangement 122 provided on each bag holder 84 is operable to displace the main gripping devices 120, 120' relative to the holding devices 98, 98' so as to separate the wicket bag from its upper tab as shown in FIG. 26.

Figure 27:
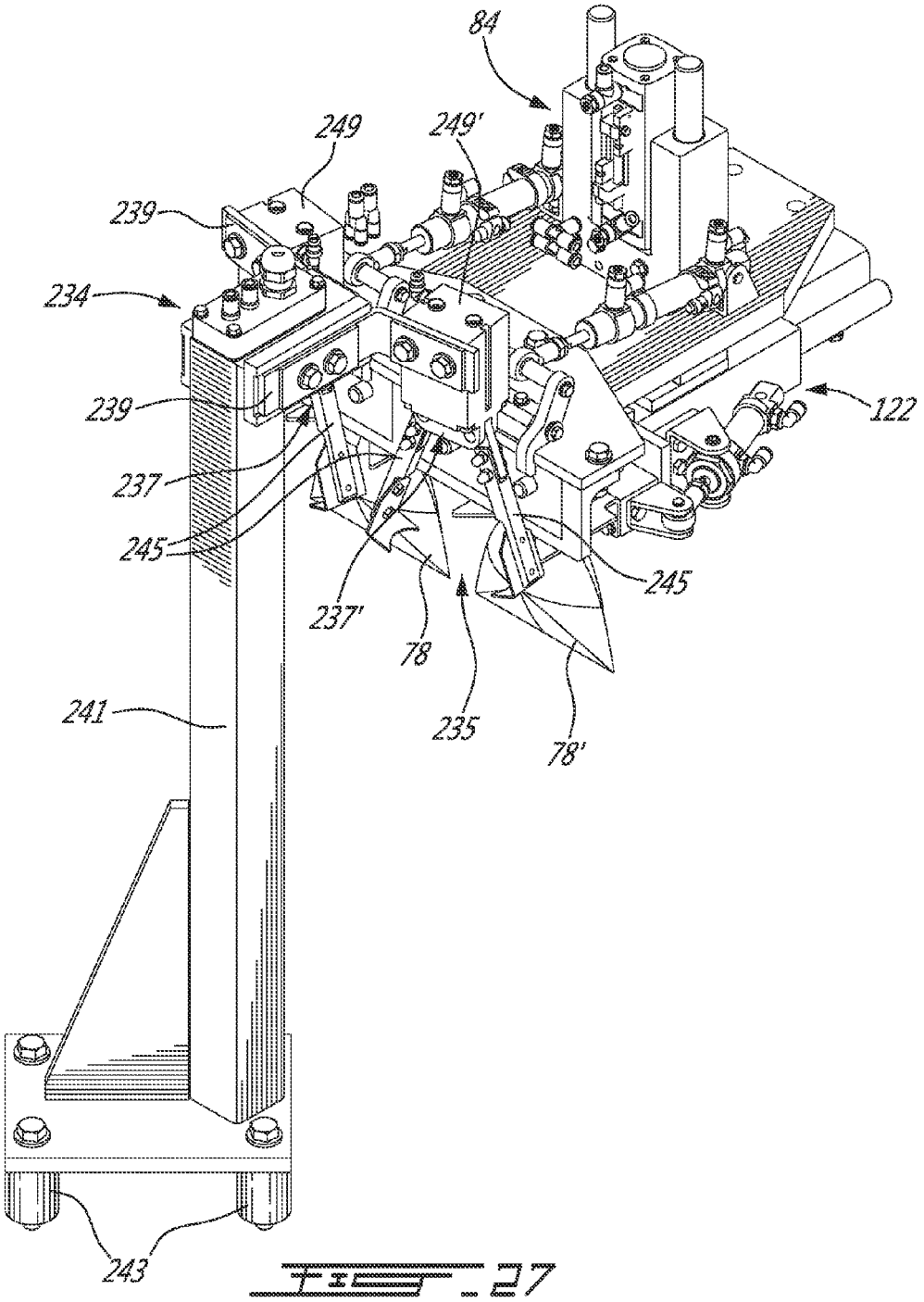
FIG. 27 is a perspective view of a wicket bag shaping station provided on the handling system of FIG. 2.
Figure 28:
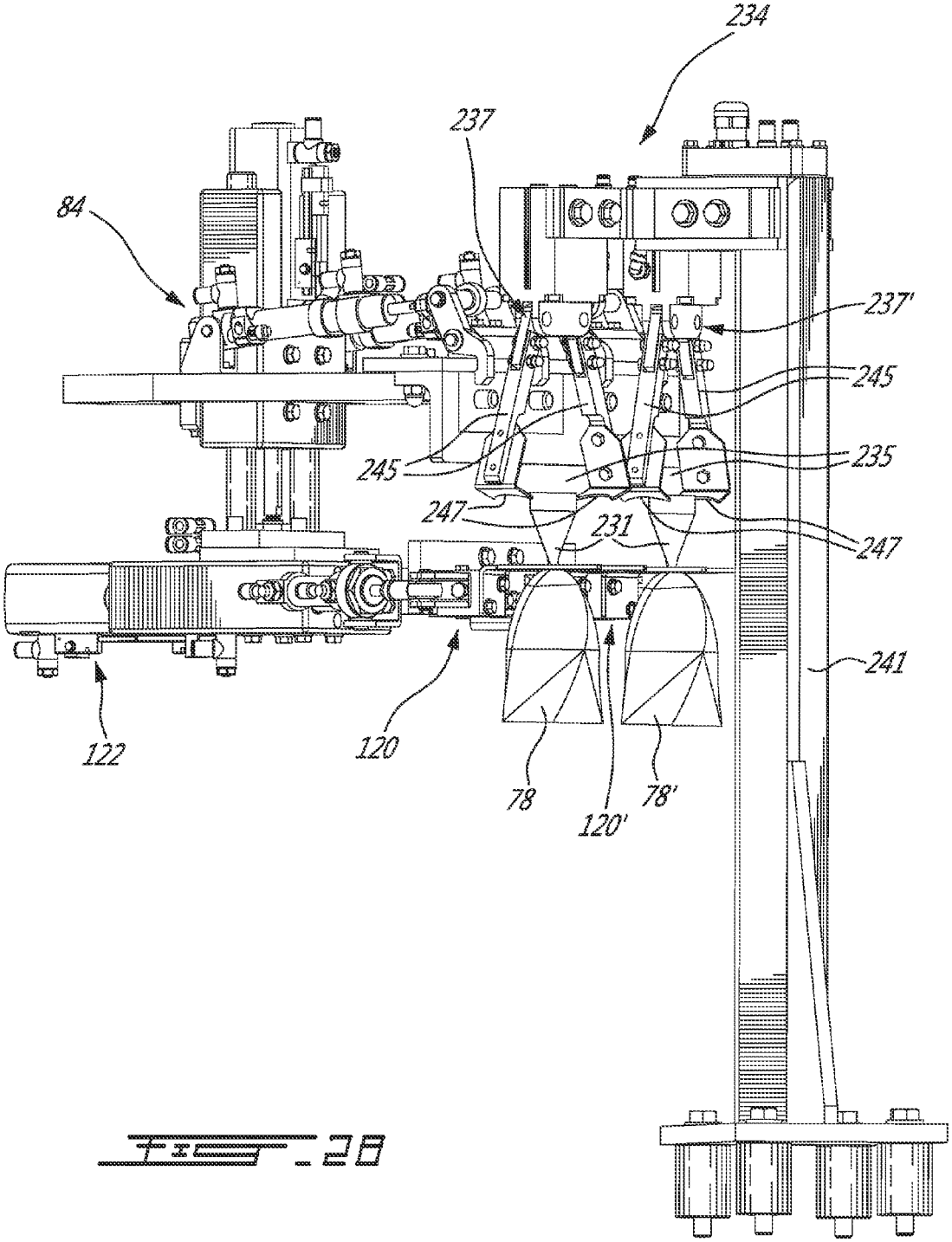
Figure 28:
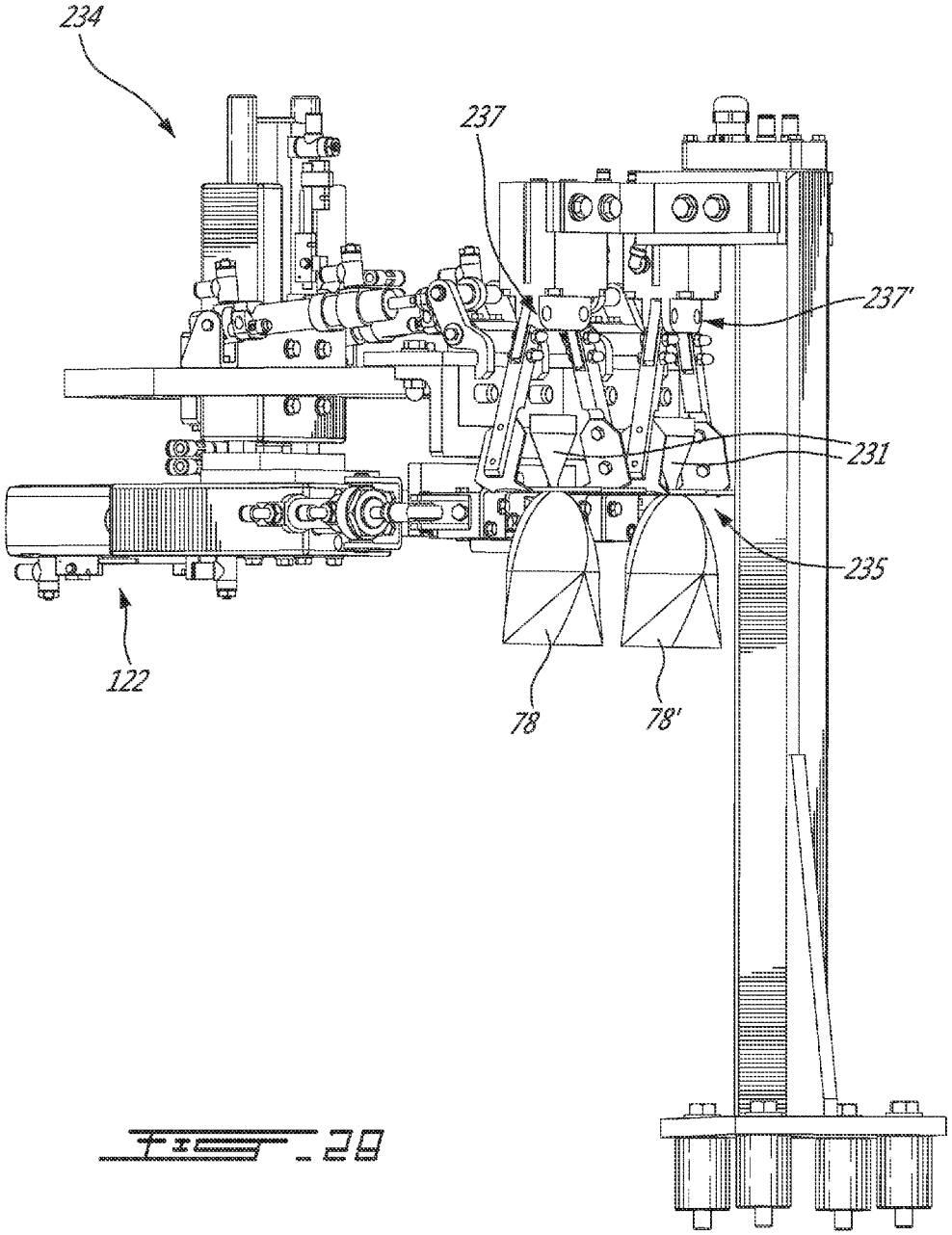
Figure 30:
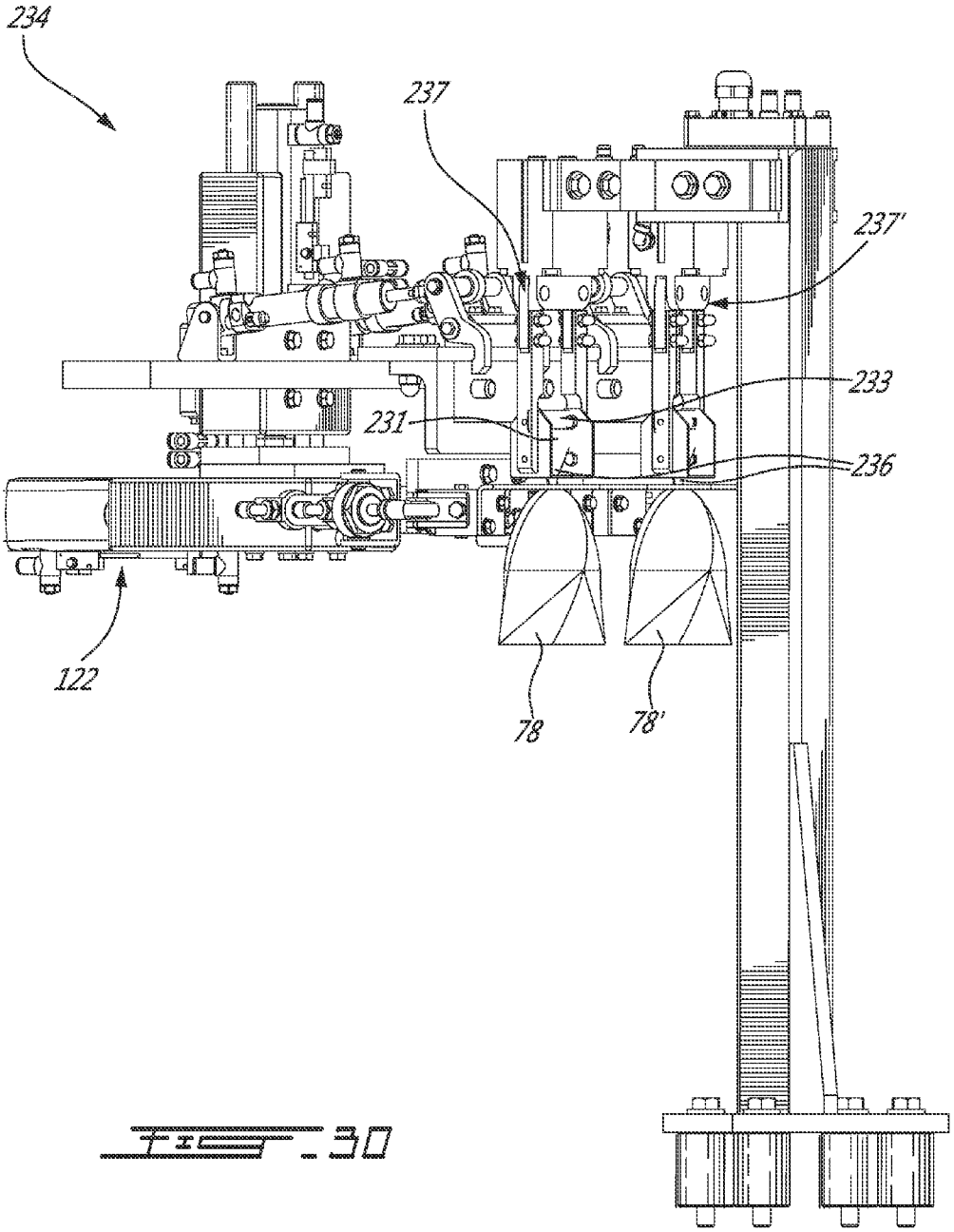
Figure 31:
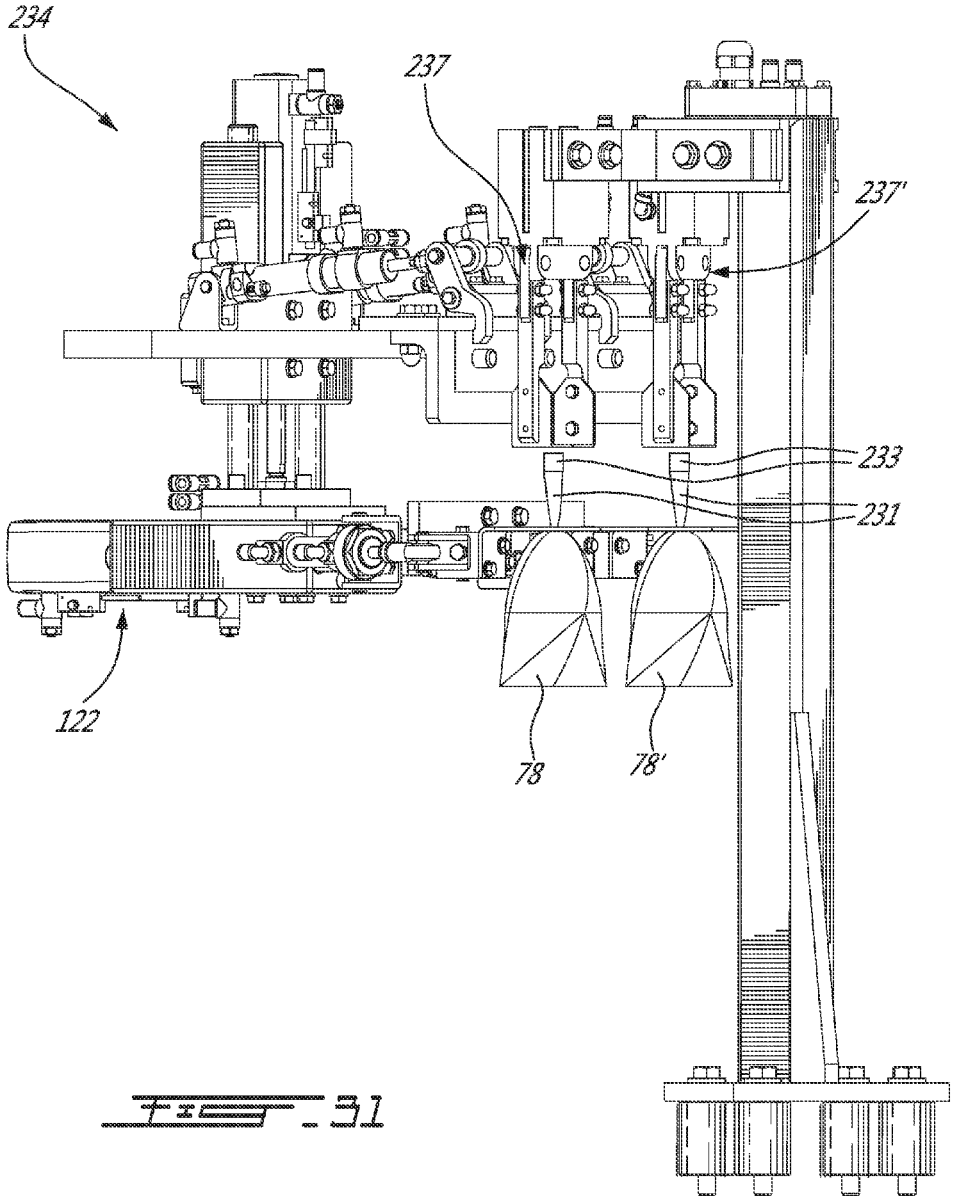
Figure 32:
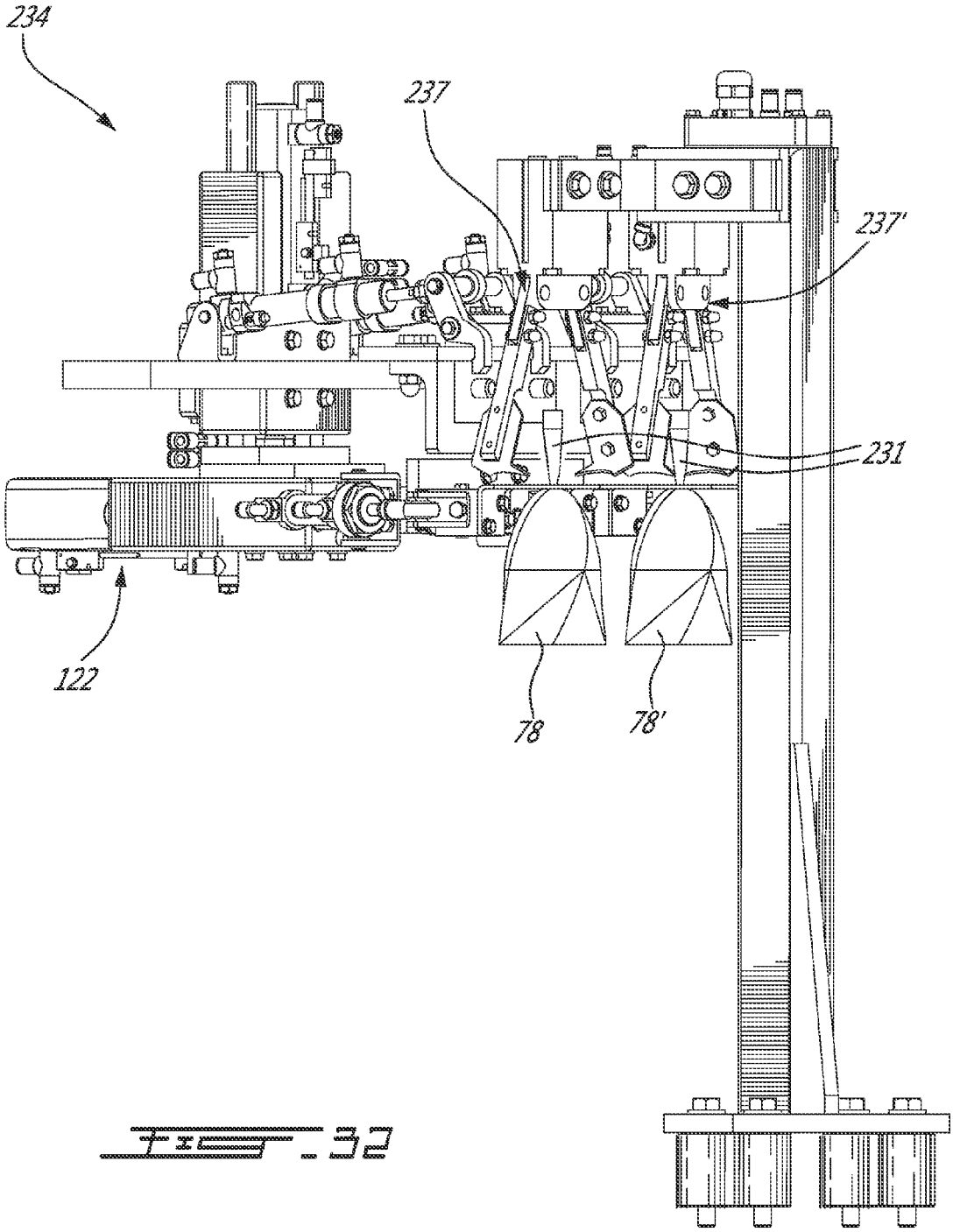

Turning now to FIG. 27 in view of FIG. 28, a wicket bag shaping station that may be included in the bag handling system will now be described. The wicket bag shaping station 234 is operatively connected to the system controller, is located at a position downstream the wicket bag filling station 198 described above and as shown in FIG. 3, and defines a shaping zone 235. The shaping station 234 is useful to give a generally elongate shape to the bag neck portion which is more adapted for subsequent bag closing. In the embodiment shown, the shaping station 234 includes first and second bag neck gripping devices 237, 237' secured with bracket assemblies 239 to a post 241 adapted to be mounted on the system main platform using bolt assemblies 243, and also receiving the electrical lines (not shown) coming from the control unit 94 as well as the pneumatic lines coming from one of the pneumatic distributors 89 provided on the handling system. Each one of neck gripping devices 237, 237' is provided with a pair of pivoting grips 245 provided with end elements 247 defining a shaping edge of a rounded profile, which grips 245 having their respective base portions operatively connected to respective pivoting actuators 249, 249' provided on gripping devices 237, 237', which are thus operable between an open position as shown in FIGS. 28 and 29 allowing receipt of the neck portion 231 of filled bags 78, 78' having been transported by the bag holder 84 to the shaping zone 235, and a closed position as shown in FIG. 30 whereby the bag neck portion 231 is gripped above the main gripping level at a position 236 distal from the bag mouth 233. It can be seen from FIG. 28 in view FIG. 29 that the mechanical arrangement 122 provided on the bag holder 84 can be operated upwardly within a vertical plane to bring the bag neck portion 231 within the shaping zone 235. Turning now to FIG. 31, the mechanical arrangement 122 can be further operated to displace the main gripping devices 120, 120' when at their closed position, relative to the neck gripping devices 237, 237', downwardly within a vertical plane in a direction so as to extend the bag neck portion 231 toward the bag mouth 233 to give the generally elongate shape to the bag neck portion 231. Then, the neck gripping devices 237, 237' and the mechanical arrangement 122 may be brought back respectively to their initial open and upper positions as shown in FIG. 32, and the movement sequence may be optionally repeated to obtain a more complete shaping of the bag neck portion 231.

Figure 33:
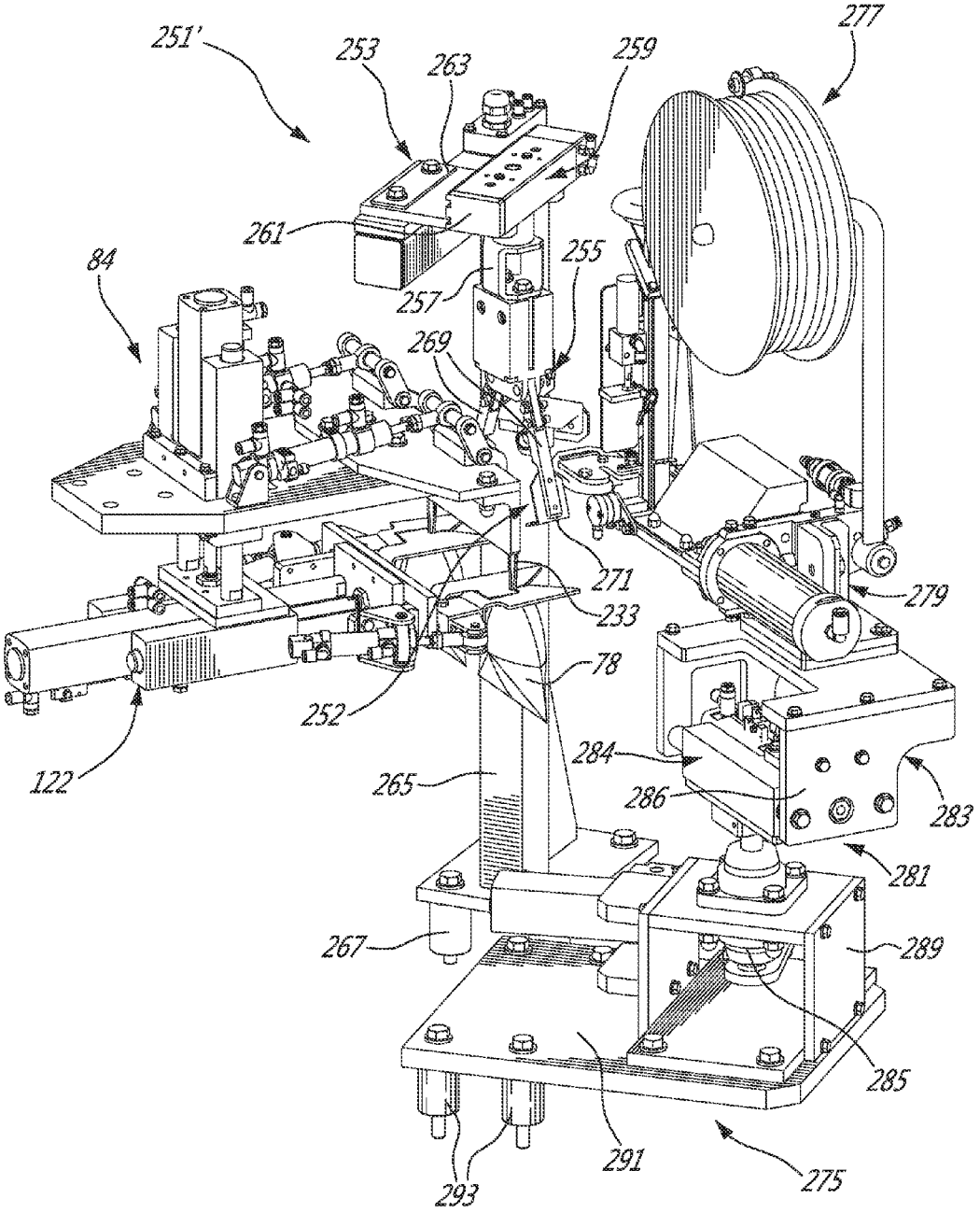
FIG. 33 is a perspective view of a wicket bag fastening station provided on the handling system of FIG. 2.
Figure 34:
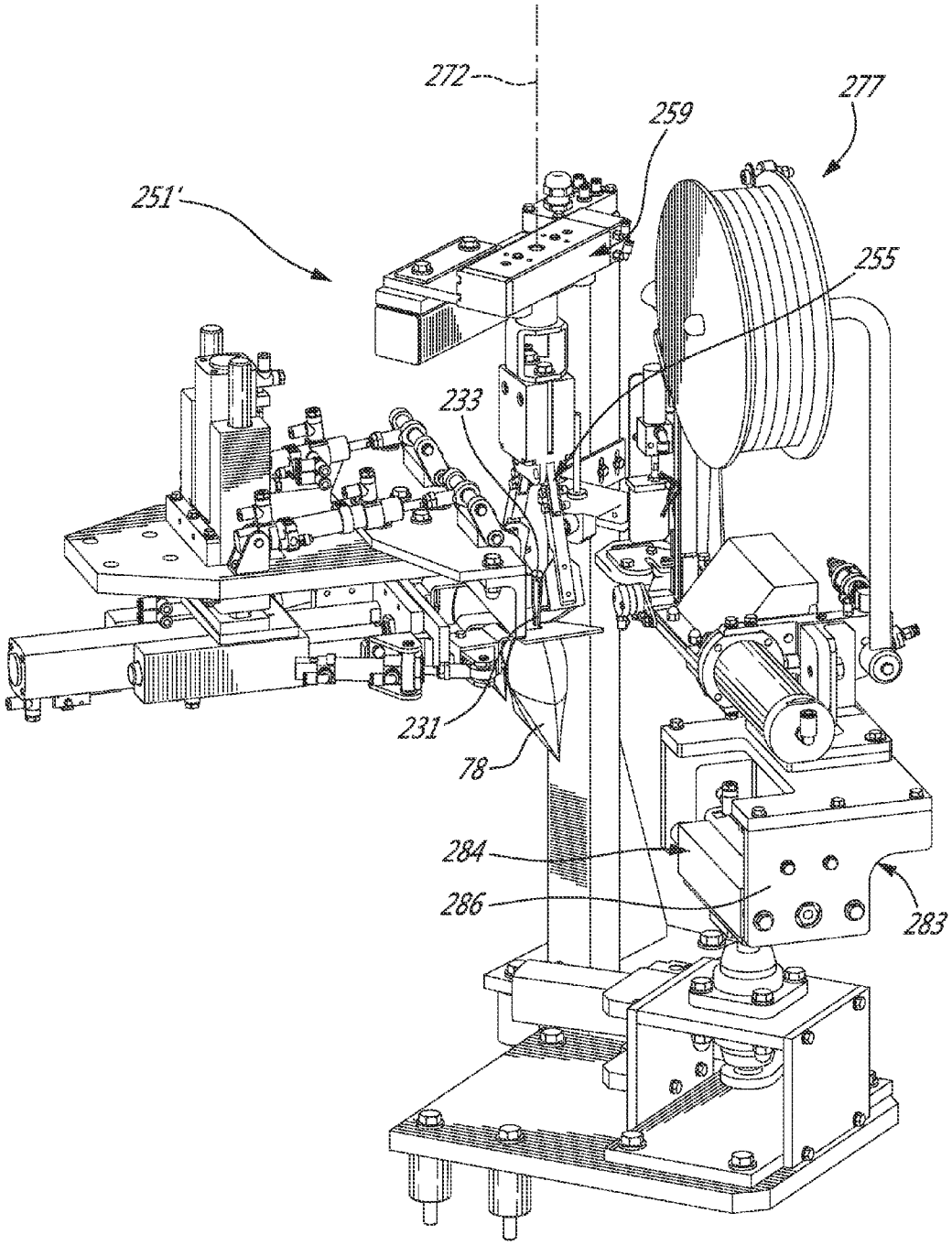
FIGS. 34 to 37 are an elevation view of the bag fastening station of FIG. 33, shown in various operation positions.
Figure 35:
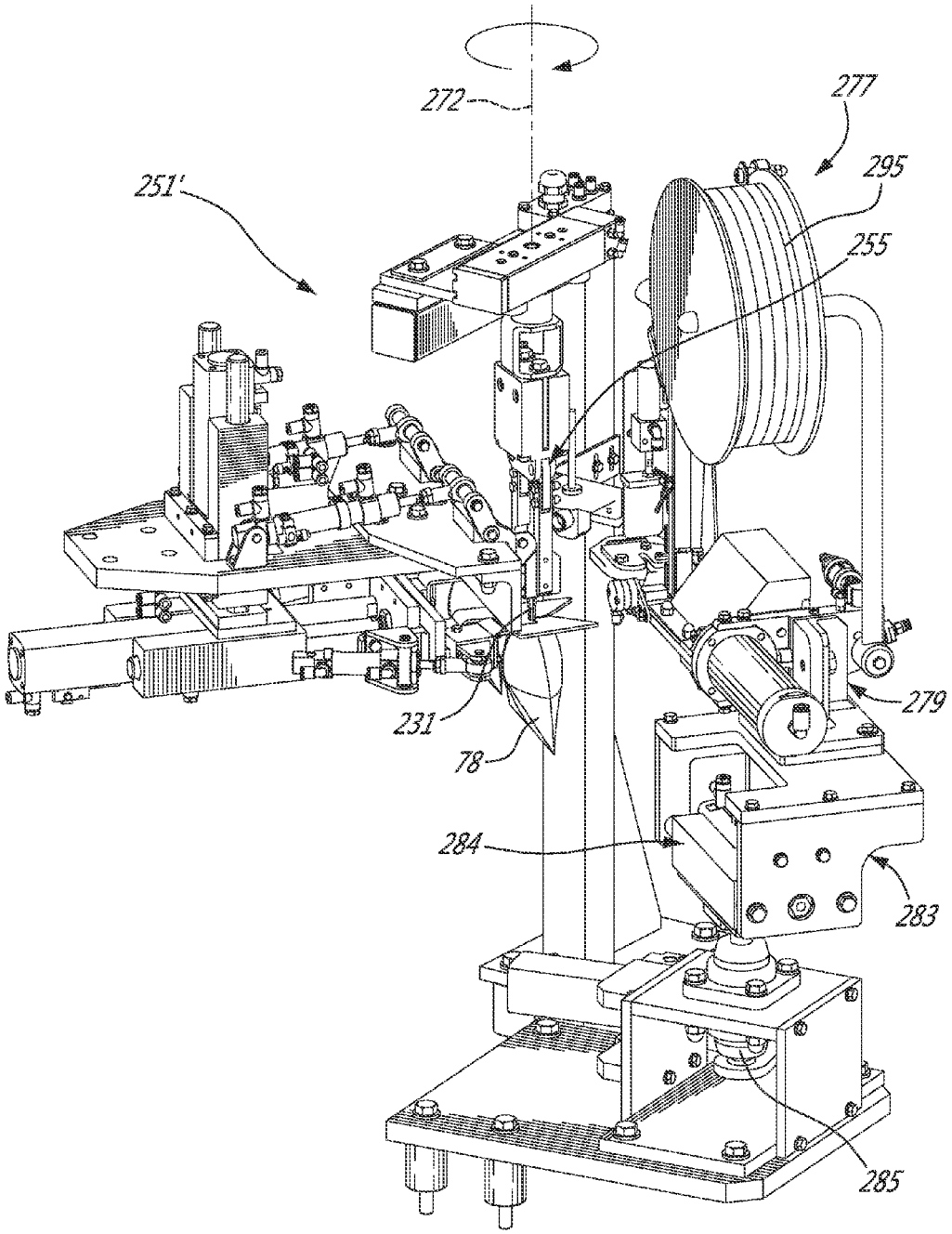
Figure 36:
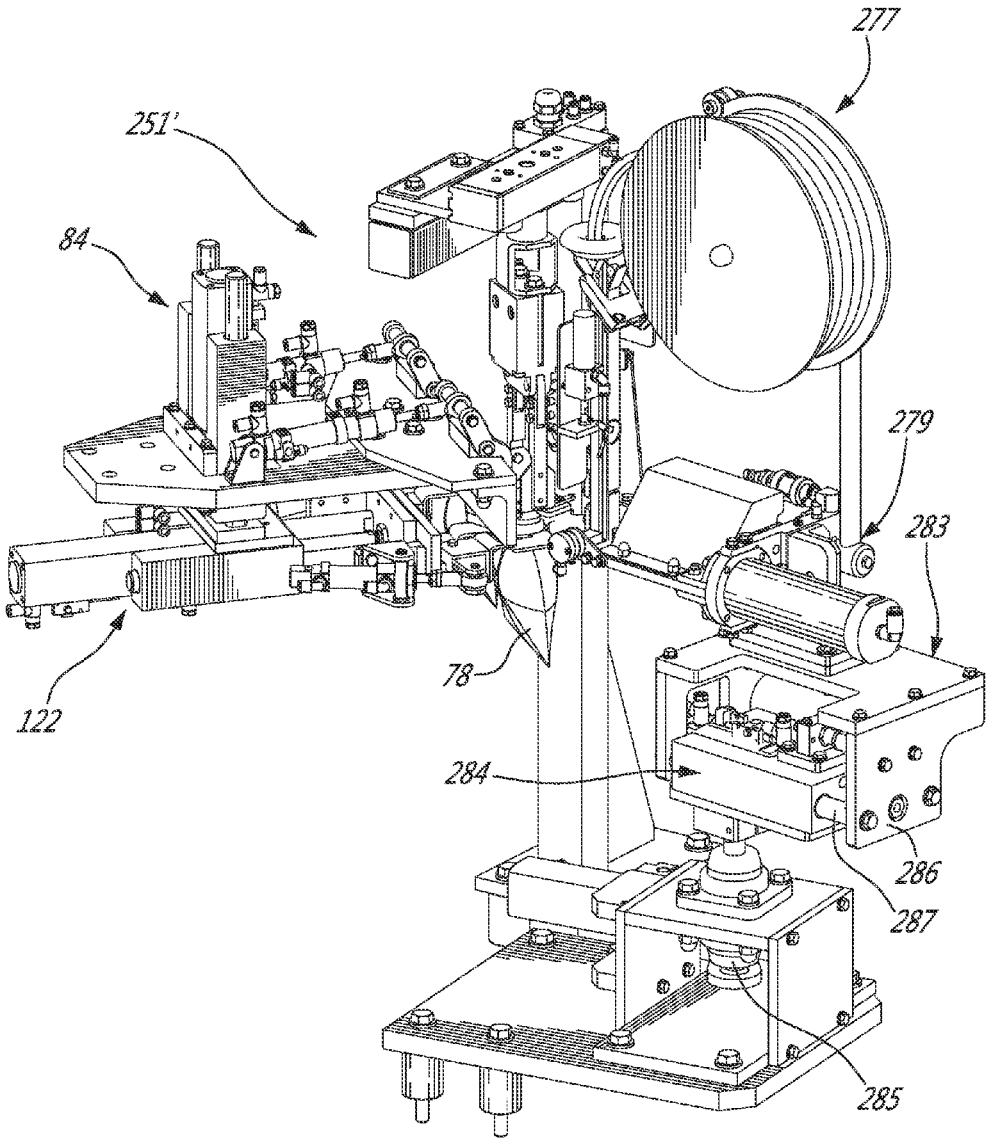
Figure 37:
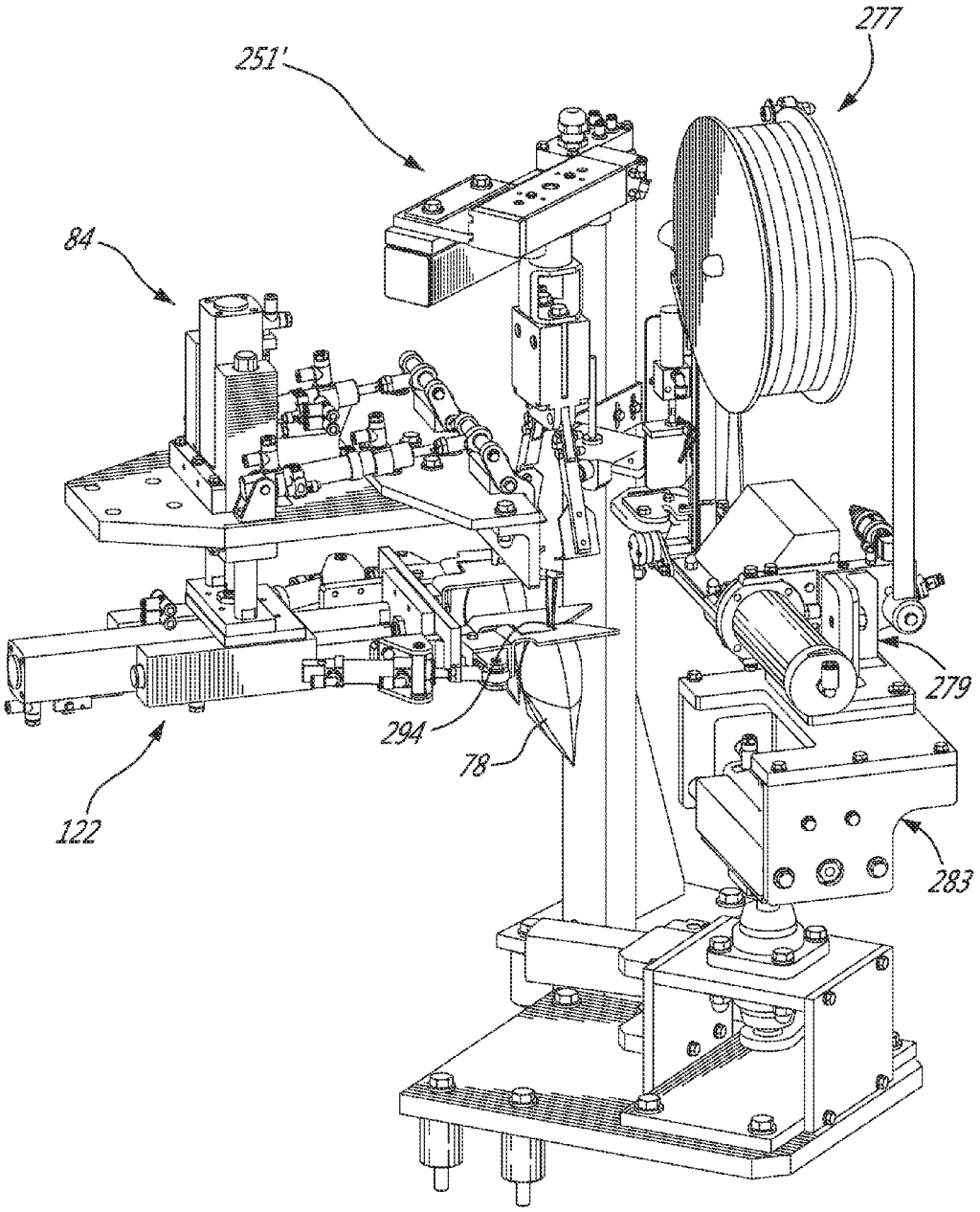

Turning now to FIG. 33, a wicket bag fastening station that may be included in the bag handling system will now be described. To provide high speed operation, the embodiment shown includes two identical bag fastening stations 251, 251' as generally shown in FIG. 3 each of which being operatively connected to the system controller, and located at adjacent positions downstream the wicket bag shaping station 234 to define respective fastening zones 252 where two wicket bags 78', 78 held by adjacent bag holder 84', 84" may be closed simultaneously. In the embodiment shown, each one of wicket bag fastening stations 251, 251' incorporates a first substation 253 including a bag mouth gripping device 255 coupled at its upper portion to the working end element 257 of a rotary actuator 259 having its base 261 secured with bracket assemblies 263 to a post 265 adapted to be mounted on the system main platform using bolt assemblies 267 and also receiving the electrical lines (not shown) coming from the control unit 94 as well as the pneumatic lines coming from one of the pneumatic distributors 89 provided on the handling system. The bag mouth gripping device 255 is provided with a pair of pivoting grips 269 provided with end elements 271 defining a grip edge, which grips 269 having their respective base portions operatively connected to a pivoting actuator 273 provided on the bag mouth gripping device 255, which is thus operable between an open position as shown in FIGS. 33 and 34 allowing receipt of the mouth portion 233 of the filled bag 78 having been transported by bag holder 84 to the fastening zone 252, and a closed position as shown in FIG. 35 whereby the bag mouth portion 233 is gripped. It can be seen from FIG. 33 in view FIG. 34 that the mechanical arrangement 122 provided on the bag holder 84 can be operated upwardly within a vertical plane to bring the extended bag neck portion 231 within the fastening zone 252. Then, the rotary actuator 259 is operated to impart corresponding rotation of typically one turn about axis 272 to the extended bag neck portion 231 with respect to the filled portion of the bag 78 below the main gripping level to form a twisted neck portion. Turning back to FIG. 33, each one of wicket bag fastening stations 251, 251' incorporates a second substation 275 including a fastening unit 277 such as model FSP 100L supplied by Tipper Tie Inc. (Apex, N.C., USA), which unit 277 is provided with a fastener setting tool 279 coupled to a further mechanical arrangement 281 including a linearly displaceable carrier 283 on which is mounted the fastener setting tool 279, and a rotary actuator 285 on which is mounted the displaceable carrier 283 through the base of a linear displacement actuator 284 having its working end 287 as shown in FIG. 36 connected to a rear end wall 286 provided on the displaceable carrier 283. The rotary actuator 285 in mounted on a sub-frame 289 secured to a base plate 291 adapted to be mounted on the system platform using bolt assemblies 293. The further mechanical arrangement 281 can be operated for moving the fastener setting tool 279 between a first position as shown in FIG. 35 distal from the bag mouth gripping device allowing transport of the filled bag 78 and a second position as shown in FIG. 36 where the fastener setting tool 279 engages the twisted neck portion of the bag and is operable to set a fastener such as a collar 294 on the twisted neck portion 231 to closed the filled bag, which collar being typically formed from a U-shaped clip untied from a flexible strip of interconnected clips fed from a reel 295 provided on the fastening setting tool 279. For so doing, the rotary actuator 285 is operated between a first angular position as shown in FIGS. 33 and 37 allowing transport of the filled bag 78 and a second angular position as shown in FIG. 36 where the fastener setting tool 279 is aligned with the twisted neck portion 231 of the bag, and the displaceable carrier 283 is then operated to move the fastener tool 279 between its aligned position and the second position as shown in FIG. 36. It can be seen from FIG. 36 in view FIG. 37 that the mechanical arrangement 122 provided on the bag holder 84 can be operated downwardly within the vertical plane to bring the closed bag 78 out of the fastening zone 252 and ready to be further transported by the bag holder 84.

Figure 38:
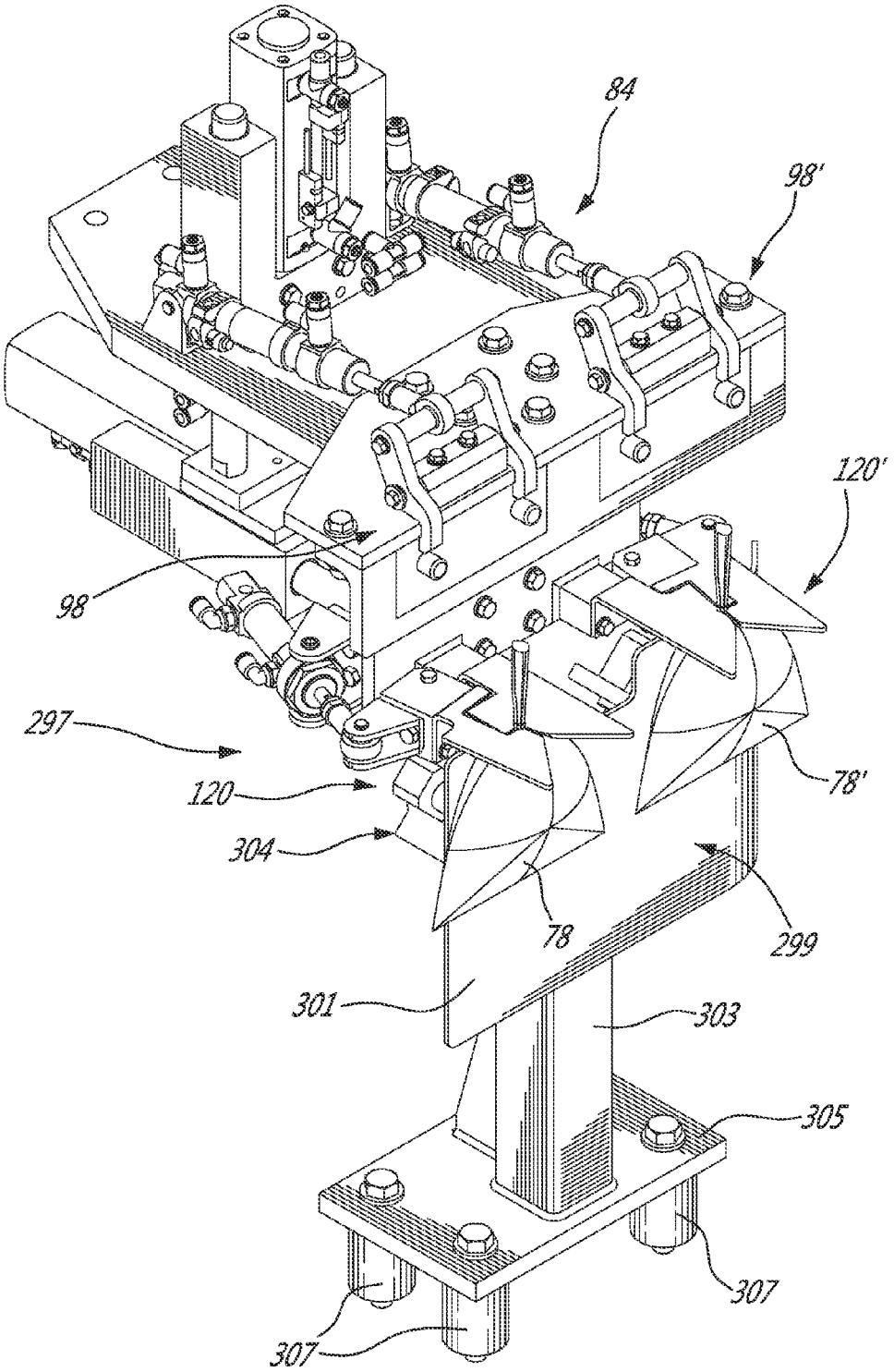
FIG. 38 is a perspective view of a wicket bag unloading station provided on the handling system of FIG. 2.
Figure 39:
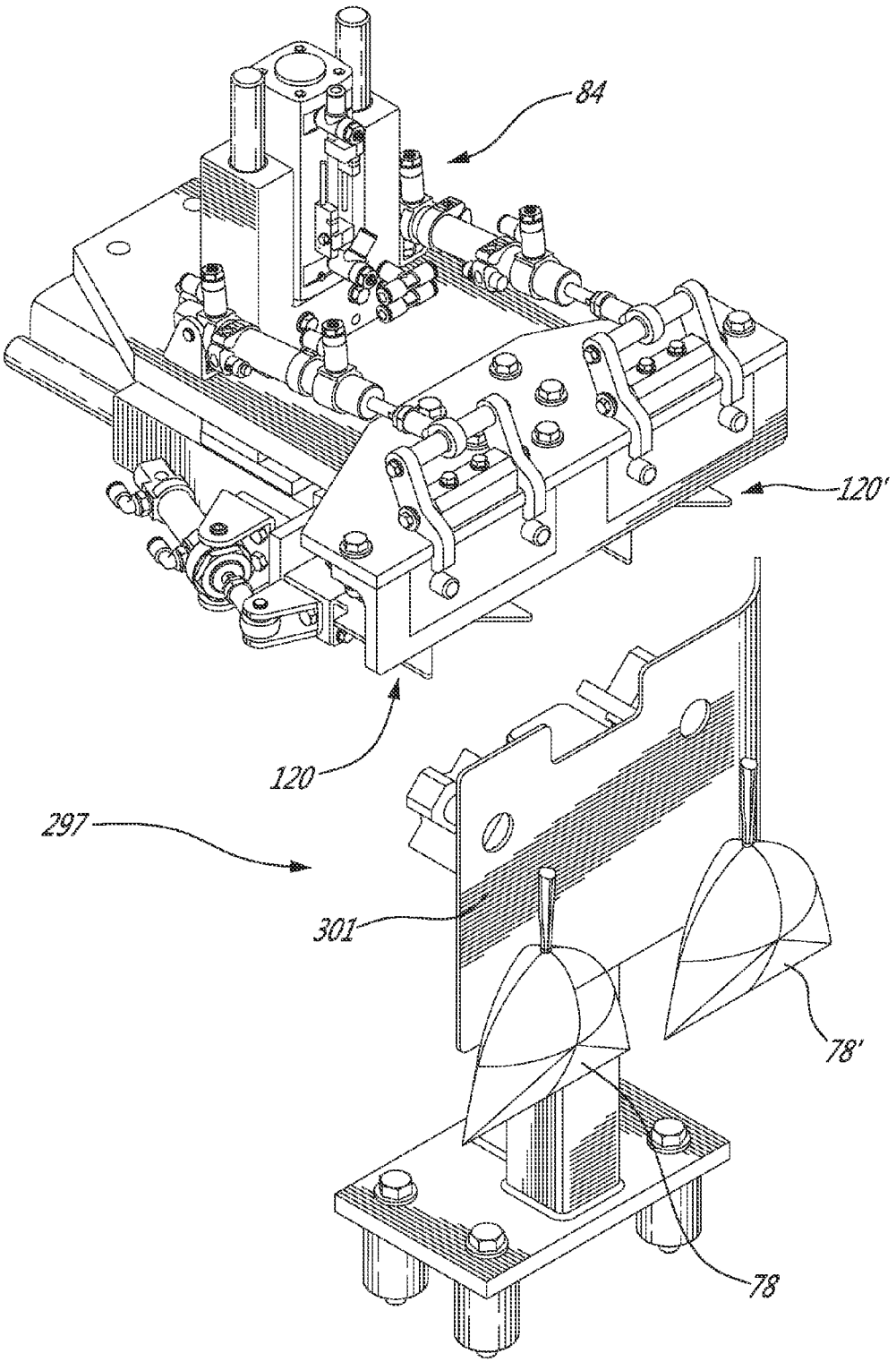
FIG. 39 is a perspective view of a wicket bag unloading station of FIG. 38, shown in a bag ejecting position.

Referring now to FIG. 38, a wicket bag unloading station that may be included in the bag handling system will now be described. The wicket bag unloading station 297 is operatively connected to the system controller, is located at a position downstream the wicket bag closing station 251' as shown in FIG. 3, and defines an unloading zone 299. The wicket bag unloading station 297 includes a stationary stopper 301 secured to a post 303 by means of an attachment assembly 304 providing positional adjustment of the stopper 301 with respect to the post 303, the latter being secured to a base plate 305 adapted to be mounted on the system main platform through bolt assemblies 307. The stopper 301 is adjusted to be initially disposed within a plane extending between the holding devices 98, 98' of the bag holder 84 and the unloading zone 299 and in alignment with the filled wicket bags transported to the unloading zone. The mechanical arrangement 122 of the bag holder 84 is then operated to displace the main gripping devices 120, 120' relative to the stopper 301 in direction to the holding devices 98, 98', while the gripping devices are brought to their from their closed position as shown in FIG. 38, to their open position as shown in FIG. 39 further allowing release of the wicket bags 78, 78', so as to cause their ejection upon impact with the stopper 301.

Figure 40:
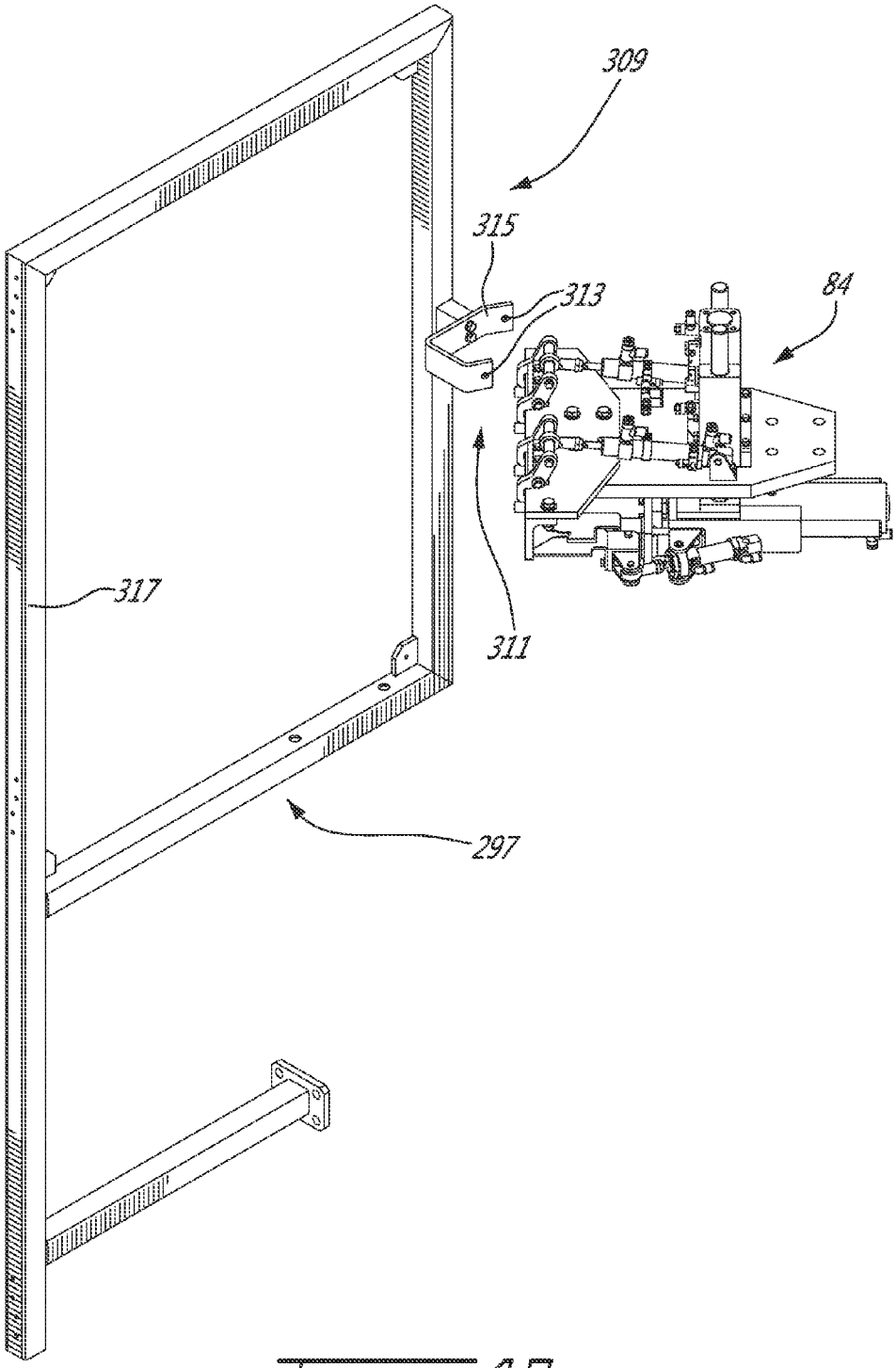
FIG. 40 is a perspective view of a bag tab removing station provided on the handling system of FIG. 2.
Figure 41:
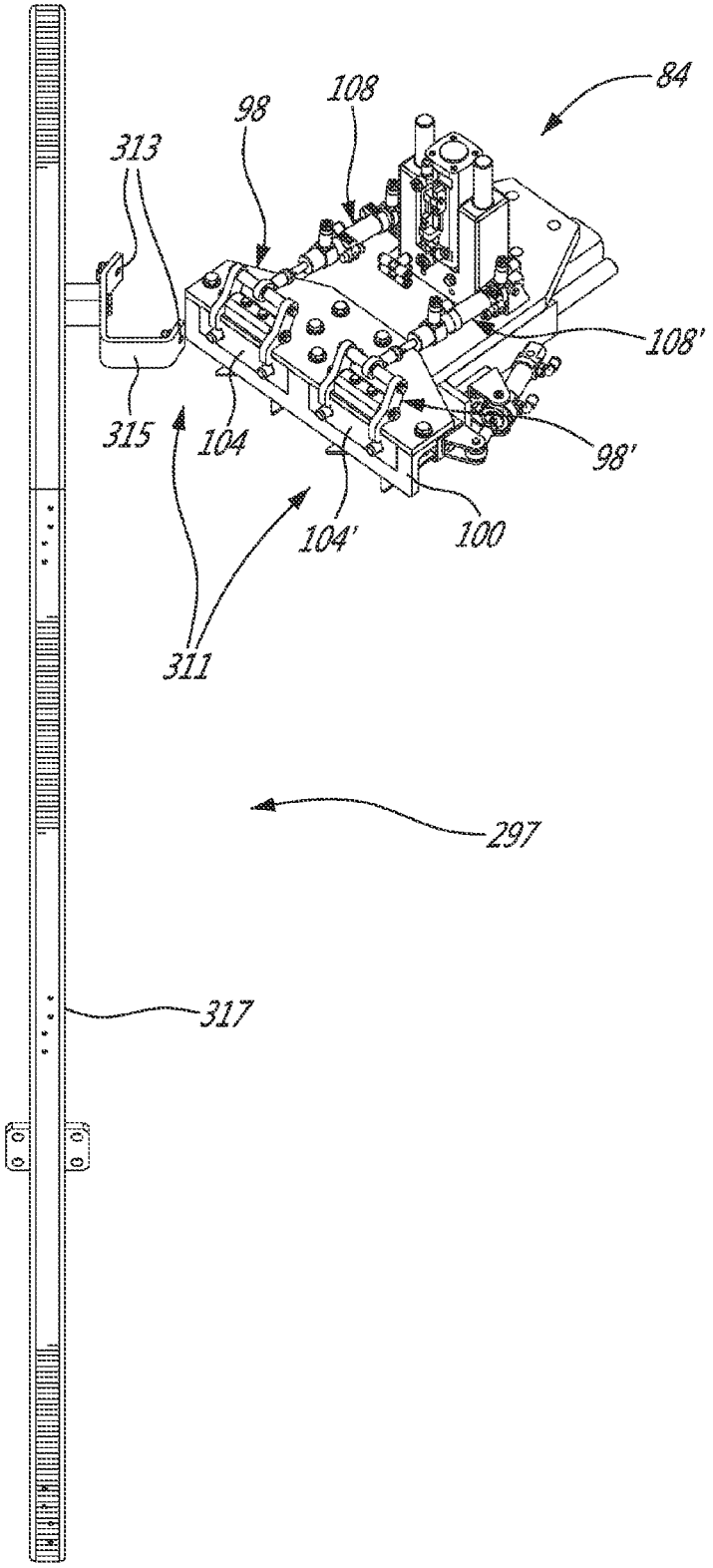
FIG. 41 is an elevation view of the bag tab removing station of FIG. 40, shown prior to bag tab ejection.
Figure 42:
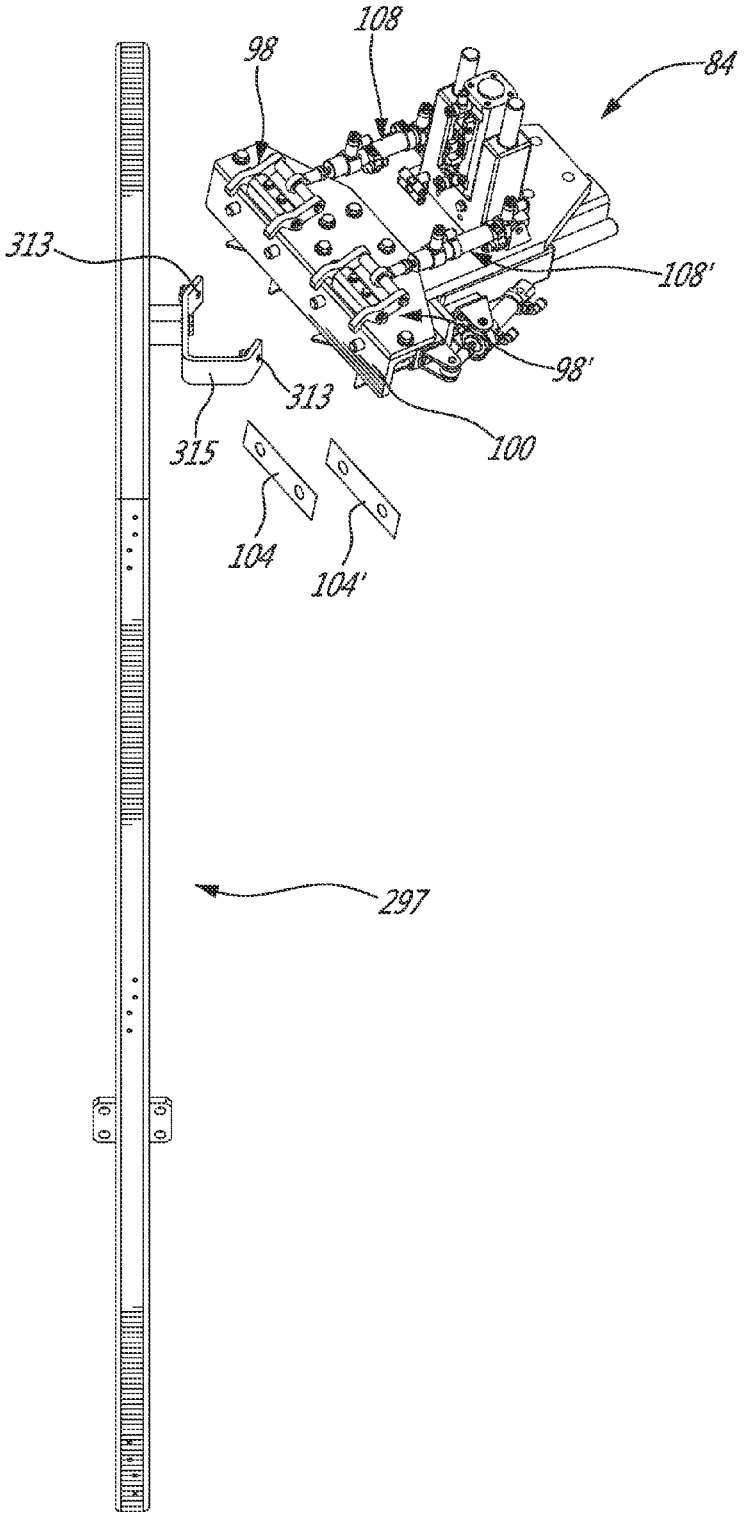
FIG. 42 is an elevation view of the bag tab removing station of FIG. 40, shown after bag tab ejection.

Referring now to FIG. 40, a wicket bag tab removing station that may be included in the bag handling system will now be described. The wicket bag tab removing station 309 is operatively connected to the controller, is located at a position as shown in FIG. 3 downstream the wicket bag unloading station 297, and defines a tab removing zone 311 where the wicket bag tabs are transported on a holder 84. The bag tab removing station 309 includes one or more air jet devices 313 for ejecting the wicket bag tabs 104, 104' shown in FIG. 41, which air jet devices are mounted to a bracket 315 secured to a sub-frame 317 adapted to be secured to the system frame. It can be appreciated from FIG. 41 in view of FIG. 42 that the holding devices 98, 98' can be operated by means of proper activation of driving mechanisms 108,108', from their closed position as shown in FIG. 41 where the bag tabs 104, 104' are gripped to the bag suspending element 100, to their open position as shown in FIG. 42 allowing release of the wicket bag tabs 104, 104' and ejection thereof upon operation of the air jet devices 313.

The invention claimed is:

1. A system for handling wicket bags, comprising:

a conveyer provided with at least one wicket bag holder each capable of transporting at least one wicket bag to at least one working position along the transport path of the conveyer, said wicket bag holder including:

at least one holding device operable between an open position allowing receipt of an upper tab provided on said wicket bag and a closed position whereby the bag is held suspended within a working zone at said working position; and at least one main gripping device coupled to a mechanical arrangement for bringing thereof toward said working zone and operable between an open position allowing receipt of the suspended wicket bag at a main gripping level below the bag upper tab and above a fillable portion of the wicket bag, and a closed position whereby the bag is gripped at said level to form a bag neck portion; and a controller operatively connected to the conveyer.

2. The system according to claim 1, further comprising a bag guiding device being disposed in substantially horizontal alignment with the bag working zone when said wicket bag has been transported to the working position, said guiding device being operable between a bag engaging position to direct the suspended wicket bag toward the main gripping device and to cooperate therewith to form the bag neck portion, and a bag releasing position during transport of the wicket bag.

3. The system according to claim 1, wherein said mechanical arrangement is operable to displace the main gripping device relative to the holding device so as to separate the wicket bag from its upper tab.

4. The system according to claim 1, wherein said holding device includes a bag suspending element provided with a plurality of pins capable of engaging a plurality of corresponding holes provided on said wicket bag upper tab, the holding device further including at least one locking element coupled to a driving mechanism and cooperating with the bag suspending element to grip the therebetween when the holding device is brought to its closed position upon operation of the driving mechanism.

5. The system according to claim 4, wherein said wicket bag holder includes a head portion, said driving mechanism including a lever assembly pivotally connecting said locking element to the holder head portion.

6. The system according to claim 5, wherein said driving mechanism further includes a linear displacement actuator having a base operatively coupled to the holder head portion and a working end operatively coupled to the lever assembly.

7. The system according to claim 1, wherein said main gripping device includes at least one grip assembly each having a stationary grip element and a movable grip element, said grip elements being shaped one relative to the other to define a recess for receiving the suspended wicket bag at said main gripping level, said movable grip element being coupled to a driving mechanism and cooperating with the stationary grip element to grip the suspended wicket bag within the recess when the main gripping device is brought to its closed position upon operation of the driving mechanism.

8. The system according claim 7, further comprising a bag guiding device being disposed in substantially horizontal alignment with the bag working zone when said wicket bag has been transported to the working position, said guiding device being operable between a bag engaging position to direct the suspended wicket bag toward the main gripping device and to cooperate therewith to form the bag neck portion, and a bag releasing position during transport of the wicket bag, wherein said bag guiding device includes a guide element of a shape adapted to confine the engaged portion of the wicket bag toward the recess, and being in overlapping relationship with said grip assembly when the bag guiding device is operated to the bag engaging position.

9. The system according claim 8, wherein the guide element has a generally V-shape.

10. The system according to claim 7, wherein said main gripping device is coupled to said mechanical arrangement through a mounting member, said driving mechanism including a lever assembly pivotally connecting said movable grip element to the mounting member.

11. The system according to claim 10, wherein said driving mechanism further includes a linear displacement actuator having a base operatively coupled to the mounting member and a working end operatively coupled to the lever assembly.

12. The system according to claim 3, wherein said mechanical arrangement includes a first driving mechanism used to displace said main gripping device relative to said holding device.

13. The system according to claim 12, wherein said wicket bag holder includes a head portion, said first driving mechanism including a linear displacement actuator having a base operatively coupled to the holder head portion and a working end operatively coupled to the main gripping device.

14. The system according to claim 12, wherein said mechanical arrangement includes a second driving mechanism used to bring said main gripping device toward said working zone by displacing the main gripping device within a substantially horizontal plane.

15. The system according to claim 14, wherein said second driving mechanism is coupled to said first driving mechanism so as to be displaced concurrently with said main gripping device relative to said holding device.

16. The system according to claim 15, wherein said wicket bag holder includes a head portion, said first driving mechanism including a first linear displacement actuator having a base operatively coupled to the holder head portion and a working end, said second driving mechanism including a second linear displacement actuator having a base operatively coupled to the working end of the first linear displacement actuator and a working end operatively coupled to the main gripping device.

17. The system according to claim 1, wherein said conveyer is a carousel, the wicket bag being transported along a circular path to said at least one working position.

18. The system according claim 1, further comprising a wicket bag filling station operatively connected to said controller and located at said working position.

19. The system according claim 18, wherein said wicket bag filling station includes:

a product distributing unit having an inlet for receiving a filling product;

a product discharging unit having at least one outlet; and wherein said working zone is a bag filling zone, said outlet being disposed above and in substantially vertical alignment with the bag filling zone when said wicket bag has been transported to the working position, to allow discharge of the product into the wicket bag.

20. The system according claim 19, wherein said wicket bag filling station further includes a vibrating bag support adapted to receive a bottom portion of the wicket bag and operable between an upper position for supporting and vibrating the wicket bag during product discharge and a lower position allowing transport of the wicket bag.

21. The system according claim 19, wherein said wicket bag filling station further includes an air jet device for opening a mouth portion of the wicket bag prior to receive the discharged product.

22. The system according claim 19, wherein said outlet is provided with a trap operable between a closed position and an open position, said product discharging unit being operable between an upper position where the product discharging unit is in communication with said inlet unit, and a lower position where said outlet is in communication with a mouth portion of the wicket bag receiving the discharged product when the trap is operated to the open position.

23. The system according claim 22, wherein each said wicket bag holder is capable of transporting first and second wicket bags by including corresponding first and second holding devices and corresponding first and second main gripping devices, said product discharging unit having first and second outlets being disposed above and in substantially vertical alignment with the bag filling zone occupied by the first and second wicket bags having been transported to the working position to allow discharge of the product into the wicket bags, the product discharging unit further has corresponding first and second product containers disposed above the first and second outlets, the product distributing unit being operable at said upper position to sequentially transfer the received filling product to the first and second product containers.

24. The system according claim 23, wherein said inlet is coupled to a pivoting mechanism selectively movable between a first position where the inlet is in communication with the first product container and a second position where the inlet is in communication with the second product container, to provide said sequential transfer of the received filling product.

25. The system according to claim 1, further comprising a wicket bag loading station operatively connected to said controller and located at a position upstream said working position and defining a loading zone.

26. The system according to claim 25, wherein said wicket bag loading station includes:

at least one wicket bag magazine; and a wicket bag transfer unit operable between at least one wicket bag pick-up position adjacent said at least one wicket bag magazine and a wicket bag loading position adjacent said loading zone where said wicket bag holder has its holding device in said open position allowing receipt of the wicket bag upper tab.

27. The system according to claim 26, wherein said wicket bag transfer unit includes a least one bag tab gripping device coupled to a driving mechanism having at least one corresponding linear displacement actuator sequentially operable from an extended position to a retracted position to provide said wicket bag pick-up operation, and sequentially operable from the retracted position to the extended position to provide said wicket bag loading operation.

28. The system according to claim 27, wherein said driving mechanism further has a rotary actuator operationally coupled to a base of said linear displacement actuator, said rotary actuator being operable between a first angular position where the bag tab gripping device is aligned with the wicket bag magazine in direction to said wicket bag pick-up position and a second angular position where the bag tab gripping device is aligned with the holding device in direction to said wicket bag loading position.

29. The system according to claim 27, wherein wicket bag loading station includes first and second wicket bag magazines disposed with respect to the loading zone in a predetermined angular relationship, said wicket bag transfer unit includes first and second bag tab gripping devices, said driving mechanism having first and second corresponding linear displacement actuators disposed one with respect to another according to said predetermined angular relationship;

wherein said first linear displacement actuator is sequentially operable from an extended position to a retracted position to provide the wicket bag pick-up operation associated with the first wicket bag magazine and the first bag tab gripping device, and sequentially operable from the retracted position to the extended position to provide the wicket bag loading operation associated with the first wicket bag magazine and the first bag tab gripping device;

wherein said second linear displacement actuator is sequentially operable from an extended position to a retracted position to provide the wicket bag pick-up operation associated with the second wicket bag magazine and the first bag tab gripping device, and sequentially operable from the retracted position to the extended position to provide the wicket bag loading operation associated with the second wicket bag magazine and the second bag tab gripping device, and wherein said controller is programmed to cause the first and second linear displacement actuators to perform their respective operation sequences alternatively.

30. The system according to claim 29, wherein said driving mechanism further has a rotary actuator operationally coupled to respective bases of said linear displacement actuators, said rotary actuator being operable between:

a first angular position where the first bag tab gripping device is aligned with the first wicket bag magazine in direction to said wicket bag pick-up position associated with the first wicket bag magazine whereas the second bag tab gripping device is aligned with the loading zone in direction to the wicket bag loading position associated with the second wicket bag magazine, and a second angular position where the first bag tab gripping device is aligned with the loading zone in direction to the wicket bag loading position associated with the first wicket bag magazine whereas the second bag tab gripping device is aligned with the second wicket bag magazine at the wicket bag pick-up position associated with the second wicket bag magazine.

31. The system according to claim 1, further comprising a wicket bag printing station operatively connected to said controller and located at a position upstream said working position and defining a printing zone.

32. The system according to claim 31, wherein said wicket bag printing station includes:

a printing unit provided with a printing head; and a wicket bag guide;

wherein the printing head and the wicket bag guide are disposed adjacent the printing zone and in a spaced parallel relationship to define a channel therebetween for receiving the wicket bag onto which information is printed when the wicket bag has been transported to the printing zone.

33. The system according to claim 32, wherein each said wicket bag holder is capable of transporting first and second wicket bags by including corresponding first and second holding devices, said printing unit including a displaceable carrier on which is mounted said printing head, said carrier being operable to be displaced in a direction parallel to said bag receiving channel so that the printing head is sequentially brought to first and second positions respectively adjacent the first and the second wicket bags onto which information is printed.

34. The system according to claim 18, further comprising a wicket bag shaping station operatively connected to said controller and located at a position downstream said wicket bag filling station and defining a shaping zone, to give a generally elongate shape to the bag neck portion.

35. The system according to claim 34, wherein said wicket bag shaping station includes:

at least one bag neck gripping device operable between an open position allowing receipt of the neck portion of a filled bag having been transported to the shaping zone and a closed position whereby the bag neck portion is gripped above said main gripping level at a position distal from the bag mouth;

wherein said mechanical arrangement is operable to displace said main gripping device when at said closed position and relative to said neck gripping device within a substantially vertical plane in a direction so as to extend the bag neck portion toward the bag mouth to give the generally elongate shape to the bag neck portion.

36. The system according to claim 34, further comprising at least one wicket bag fastening station operatively connected to said controller and located at a position downstream said wicket bag shaping station and defining a fastening zone.

37. The system according to claim 36, wherein said wicket bag fastening station includes:

a first substation including:

a bag mouth gripping device operable between an open position allowing receipt of the mouth portion of the filled bag having been transported to the fastening zone and a closed position whereby the bag mouth portion is gripped;

a rotary actuator coupled to said bag mouth gripping device for rotation thereof and operable to impart corresponding rotation to the extended bag neck portion with respect to the filled portion of the bag below the main gripping level to form a twisted neck portion;

a second substation including:

a fastening unit provided with a fastener setting tool coupled to a further mechanical arrangement operable for moving the fastener setting tool between a first position distal from the bag mouth gripping device allowing transport of the filled bag and a second position where the fastener setting tool engages the twisted neck portion of the bag and is operable to set a fastener on the twisted neck portion to closed the filled bag.

38. The system according to claim 37, wherein said further mechanical arrangement includes a linearly displaceable carrier on which is mounted said fastener setting tool, and a rotary actuator on which is mounted said displaceable carrier, said rotary actuator being operable between a first angular position allowing transport of the filled bag and a second angular position where the fastener setting tool is aligned with the twisted neck portion of the bag, said displaceable carrier being operable to move the fastener tool between its aligned position and said second position.

39. The system according to claim 36, further comprising a wicket bag unloading station operatively connected to said controller and located at a position downstream said wicket bag closing station and defining an unloading zone, wherein the open position of said main gripping device further allows release of said wicket bag, the main gripping device being further operable between said closed position and said open position when the wicket bag has been transported to the unloading zone.

40. The system according to claim 39, wherein said wicket bag unloading station includes a stationary stopper initially disposed within a plane extending between the holding device and the unloading zone and in alignment with said wicket bag, wherein said mechanical arrangement is further operable to displace the main gripping device relative to said stationary stopper in direction to the holding device so as to cause ejection of the wicket bag upon impact with said stopper.

41. The system according to claim 39, further comprising a wicket bag tab removing station operatively connected to said controller and located at a position downstream said wicket bag unloading station and defining a tab removing zone, wherein the open position of said holding device further allows release of said wicket bag tab, the holding device being further operable between said closed position and said open position when the wicket bag tab has been transported to the tab removing zone.

42. The system according claim 41, wherein said bag tab removing station includes an air jet device for ejecting said wicket bag tab.

43. A method for handling wicket bags comprising the steps of:

i) providing a conveyer having at least one wicket bag holder each capable of transporting at least one wicket bag along the transport path of the conveyor to at least one working position and provided with at least one holding device;

ii) operating the holding device to an open position allowing receipt of an upper tab provided on said wicket bag;

iii) operating the holding device to a closed position whereby the bag is held suspended within a working zone at said working position;

iv) providing a main gripping device coupled to a mechanical arrangement and bringing said main gripping device to said working zone;

v) operating the gripping device to an open position allowing receipt of the suspended wicket bag at a main gripping level below said bag upper tab and above a fillable portion of the wicket bag; and vi) operating the gripping device to a closed position whereby the bag is gripped at said level to form a bag neck portion.

44. The method according claim 43, further comprising between said operating steps v) and vi), the step of:

v') engaging the wicket bag at said main gripping level to guide thereof toward the main gripping device.

45. The method according claim 43, further comprising the step of:

vii) displacing the main gripping device relative to the holding device so as to separate the wicket bag from its upper tab.

46. The method according claim 44, wherein said working zone is a bag filling zone, the method further comprising between said engaging step v') and operating step vi) the step of:

v") discharging a filling product into the wicket bag.

47. The method according claim 46, wherein said discharging step v") is performed while supporting and vibrating a bottom portion of said wicket bag.

48. The method according claim 46, further comprising between said engaging step v') and discharging step v") the step of:

a) opening a mouth portion of the wicket bag for receiving the filling product.

49. The method according claim 46, wherein said wicket bag holder is capable of transporting first and second wicket bags by including corresponding first and second holding devices and corresponding first and second main gripping devices, said discharging step v") being performed simultaneously for said wicket bags.

50. The method according claim 44, further comprising before said operating step ii) a step of:

i') providing at least one wicket bag magazine; and further comprising between said steps ii) and iii) the step of:

ii') transferring said wicket bag from the wicket bag magazine to the holding device.

51. The method according claim 44, further comprising between said operating step iii) and providing step iv) the step of:

a) printing information onto said wicket bag.

52. The method according claim 46, further comprising after said operating step vi) the step of:

b) giving a generally elongate shape to the bag neck portion.

53. The method according claim 52, further comprising after said giving step b), the steps of:

c) twisting the bag neck portion; and d) setting a fastener on the twisted neck portion to close the filled bag.

54. The method according claim 53, further comprising after said twisting step c) the step of:

e) unloading the filled bag by operating the gripping device to an open position allowing release of said wicket bag.

55. The method according claim 54, further comprising after said unloading step e), the step of:

f) removing the wicket bag tab by operating the holding device to an open position allowing release of the wicket bag tab.

* * * * *